US005571245A

United States Patent [19]

Ooyabu et al.

[11] Patent Number: 5,571,245

[45] Date of Patent: Nov. 5, 1996

[54] IGNITION APPARATUS FOR INTERNAL COMBUSTION ENGINE

[75] Inventors: Shinji Ooyabu, Anjo; Kazuhiro Yamada, Chiryu; Mitsuyasu Enomoto, Kariya, all of Japan

[73] Assignee: Nippondenso Co., Ltd., Kariya, Japan

[21] Appl. No.: 525,194

[22] Filed: Sep. 8, 1995

[30] Foreign Application Priority Data

Sep. 9, 1994 [JP] Japan ..... 6-215139
Dec. 19, 1994 [JP] Japan ..... 6-314866

[51] Int. Cl.[6] ..... F02P 3/04; F02P 17/12

[52] U.S. Cl. ..... 123/630; 123/644; 123/647

[58] Field of Search ..... 123/630, 644, 123/647, 652

[56] References Cited

U.S. PATENT DOCUMENTS

| | | | |
|---|---|---|---|
| 5,044,328 | 9/1991 | Umezaki | 123/647 |
| 5,143,042 | 9/1992 | Scheid | 123/630 |
| 5,226,394 | 7/1993 | Shimasaki et al. | 123/630 |
| 5,239,973 | 8/1993 | Murata et al. | 123/647 |
| 5,299,543 | 4/1994 | Taruya et al. | 123/630 |
| 5,301,650 | 4/1994 | Neumayer et al. | 123/630 |
| 5,309,884 | 5/1994 | Fukui et al. | 123/630 |
| 5,309,888 | 5/1994 | Deutsch et al. | 123/630 |

FOREIGN PATENT DOCUMENTS

| | | |
|---|---|---|
| 58-10160 | 1/1983 | Japan . |
| 63-25374 | 2/1988 | Japan . |
| 64-35078 | 2/1989 | Japan . |

OTHER PUBLICATIONS

Journal of Nippondenso Technical Disclosure No. 52–163, published on Mar. 15, 1987.

*Primary Examiner*—Willis R. Wolfe
*Attorney, Agent, or Firm*—Cushman, Darby & Cushman

[57] ABSTRACT

In an ignition apparatus for an internal combustion engine, an ECU produces an ignition signal to an igniter/coil circuit with an igniter and ignition coil, which in turn sends back a monitor signal for ignition failure determination in the ECU. The ignition signal and the monitor signal are sent through a single signal line. The monitor signal is produced based on a primary current or a secondary current of the ignition coil.

17 Claims, 23 Drawing Sheets

FIG. 2
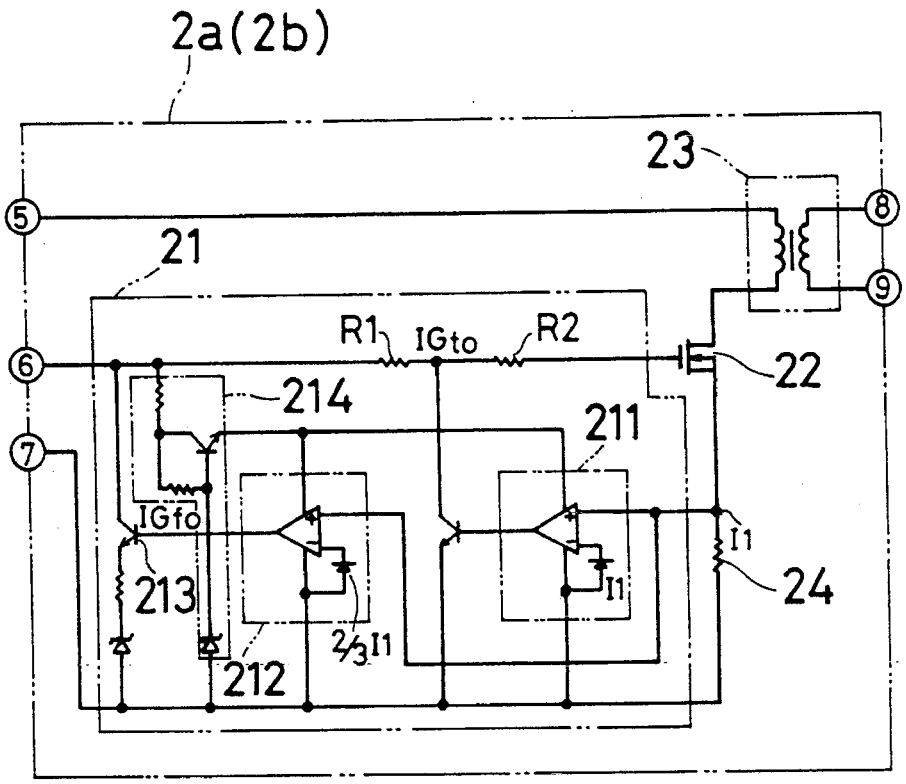
FIG. 3A
FIG. 3B
FIG. 3C
FIG. 3D
FIG. 3E
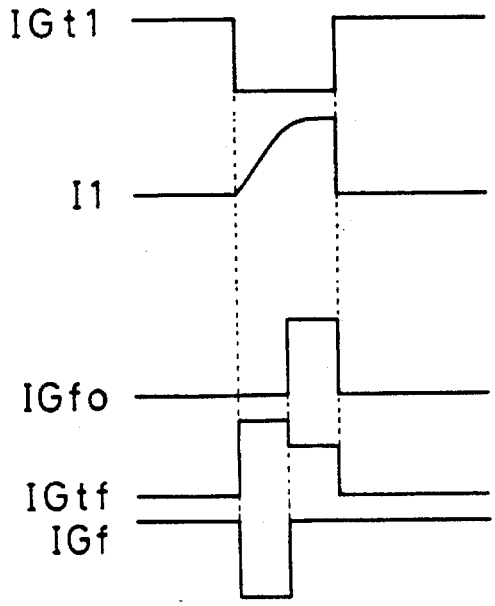

FIG. 5A
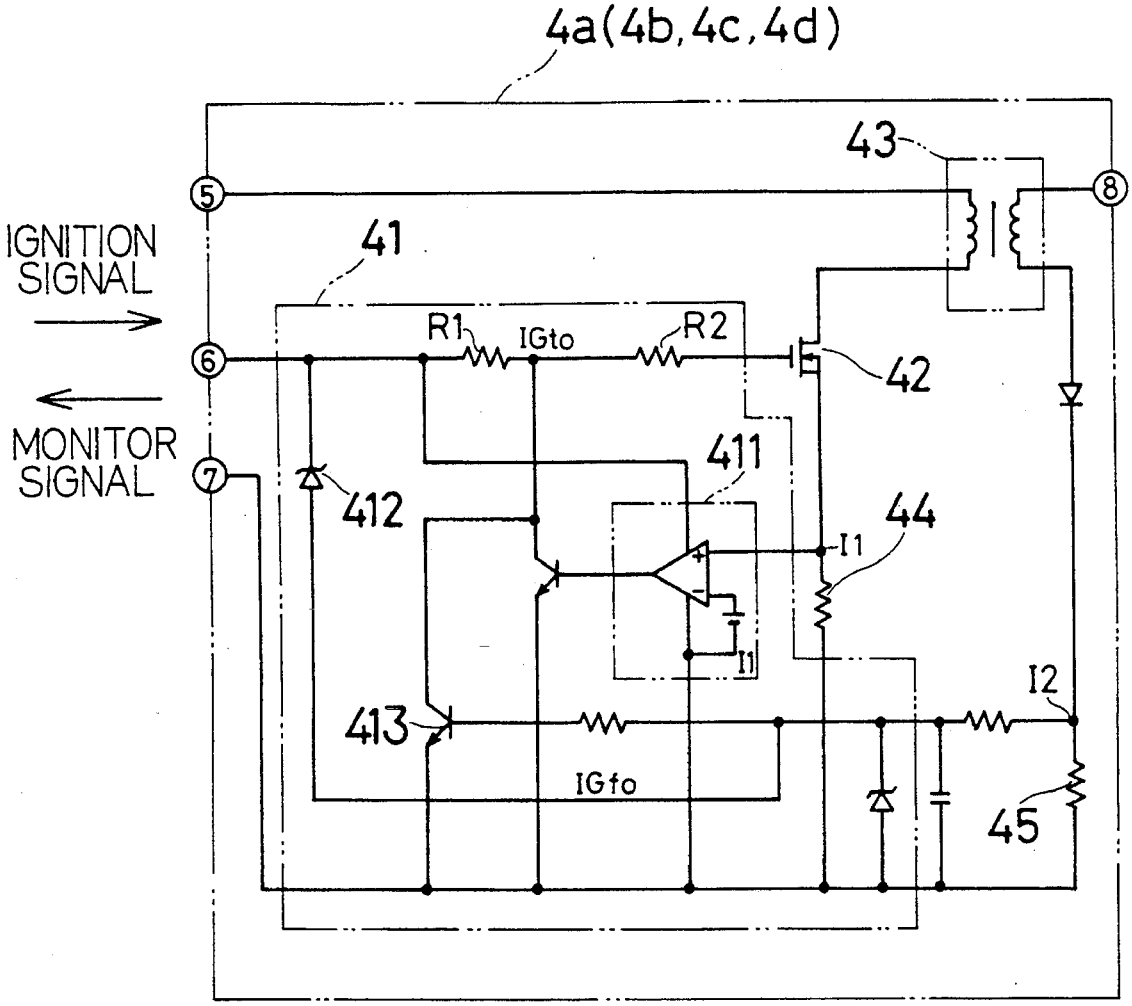
FIG. 6A
FIG. 6B
FIG. 6C
FIG. 6D
FIG. 6E
FIG. 6F
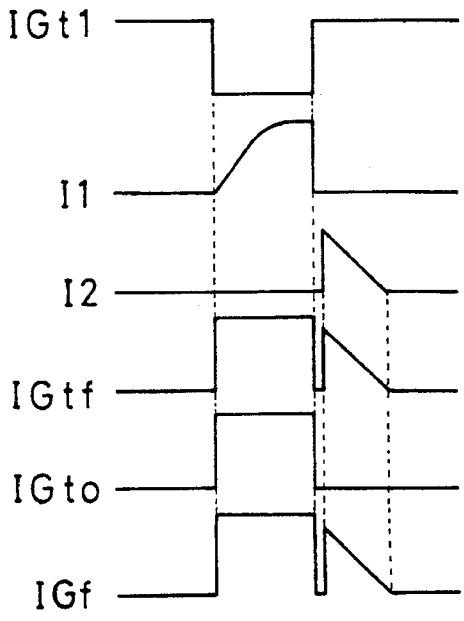

IGt1

I1

Vc

IGfo

IGtf

IGf

FIG. 16
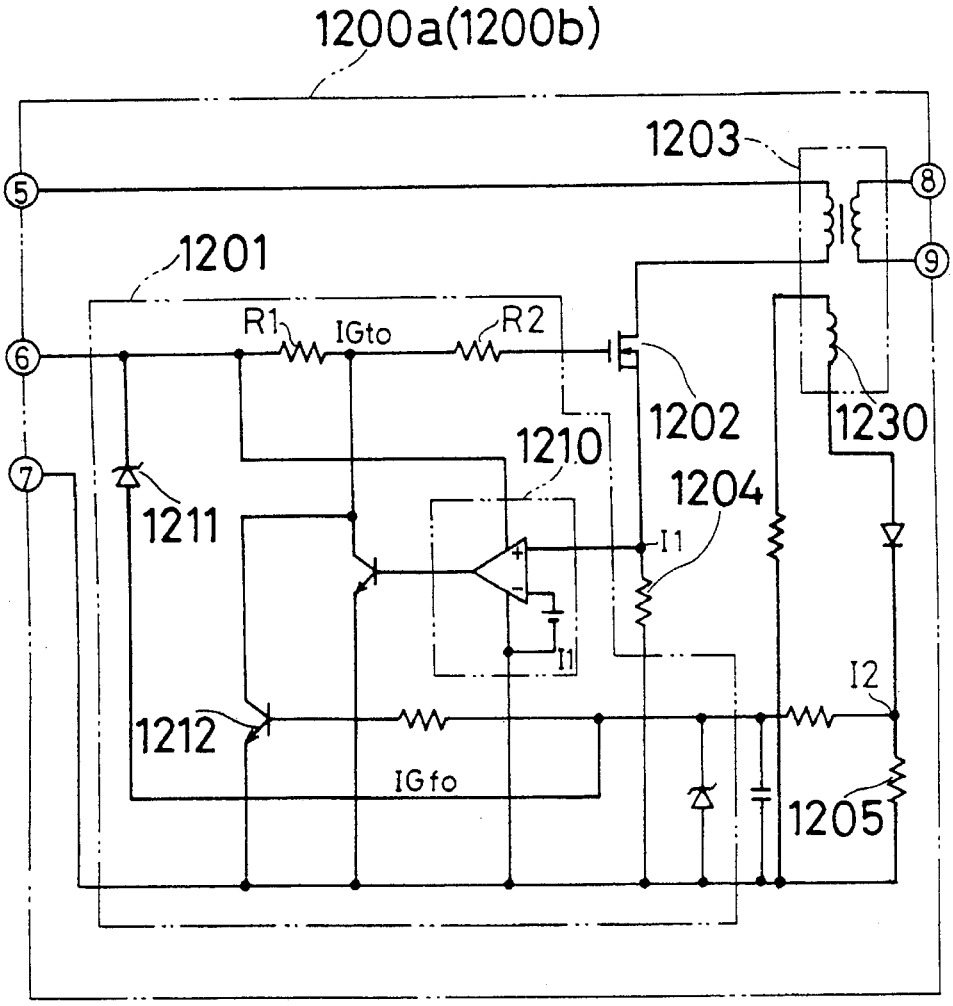
FIG. 17A
FIG. 17B
FIG. 17C
FIG. 17D
FIG. 17E
FIG. 17F
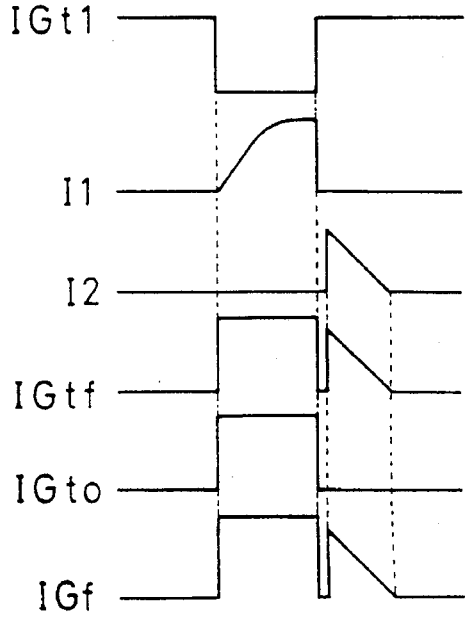

FIG. 19
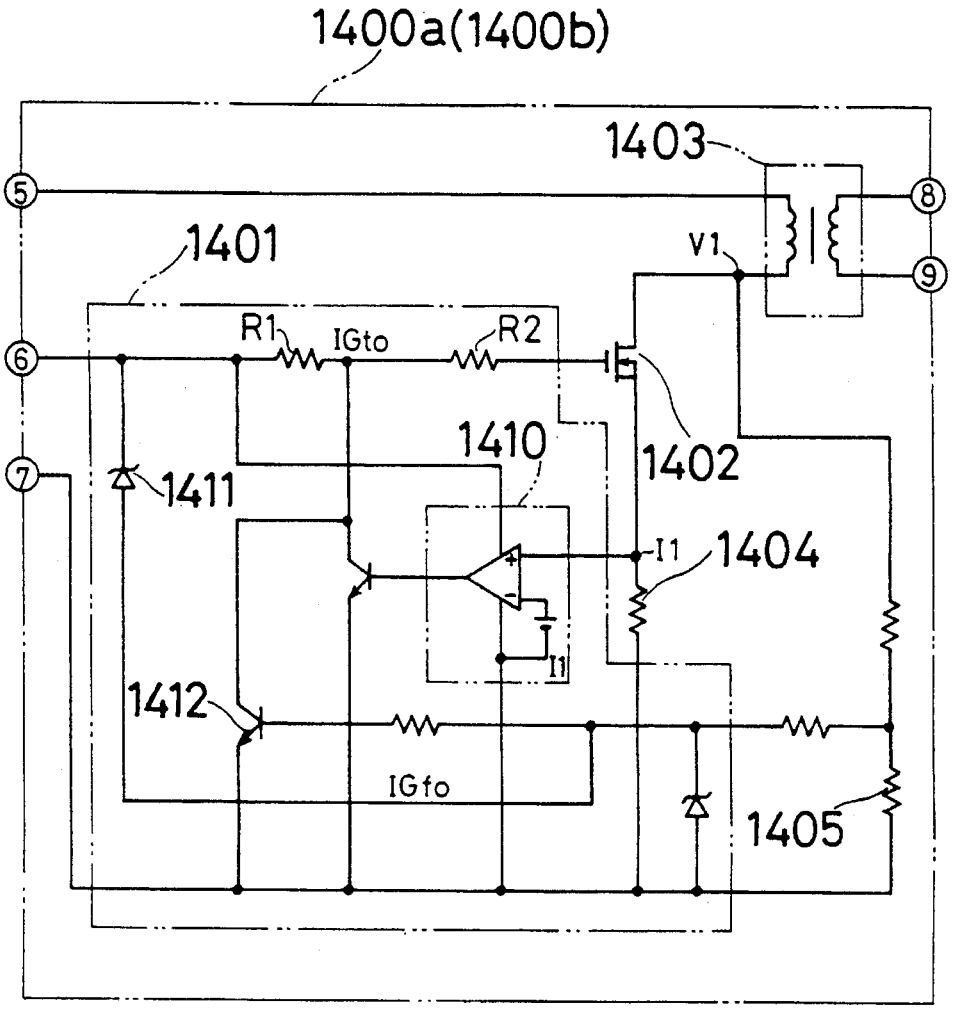
FIG. 20A
FIG. 20B
FIG. 20C
FIG. 20D
FIG. 20E
FIG. 20F
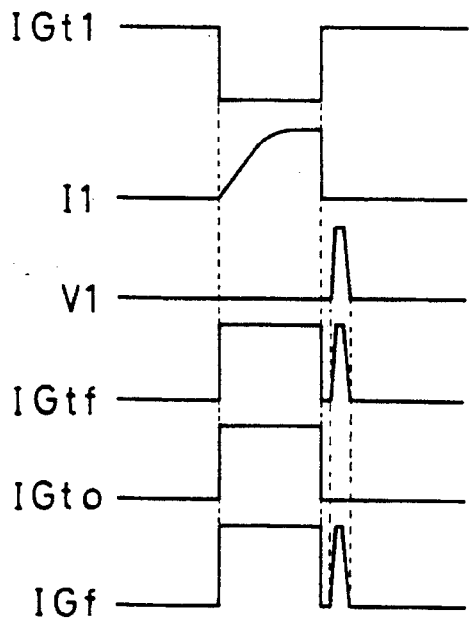

FIG. 22
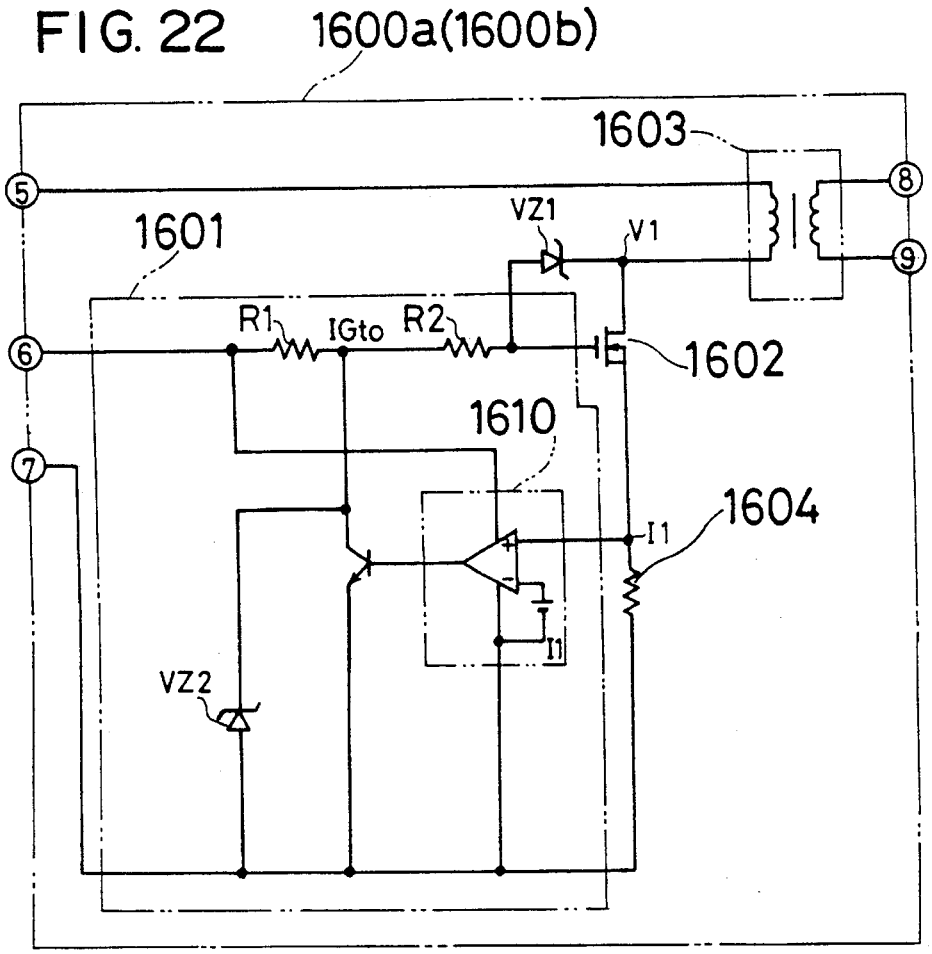
FIG. 23A
FIG. 23B
FIG. 23C
FIG. 23D
FIG. 23E
FIG. 23F
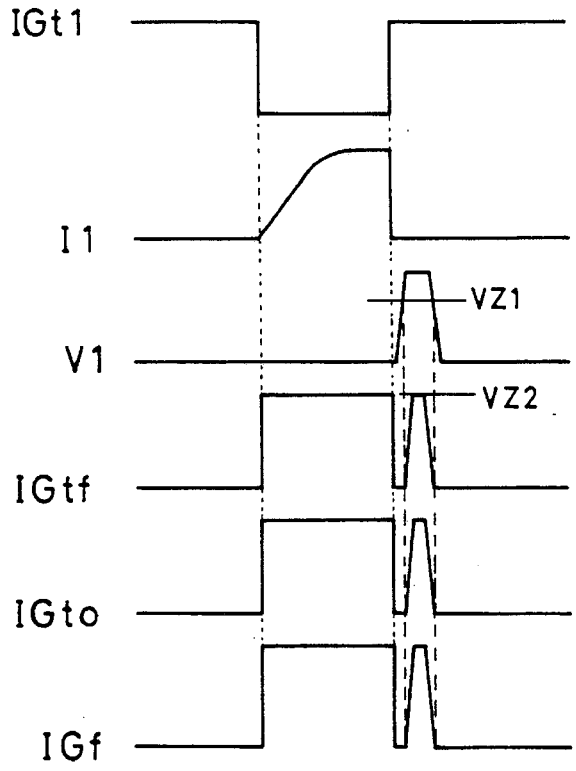

FIG. 25
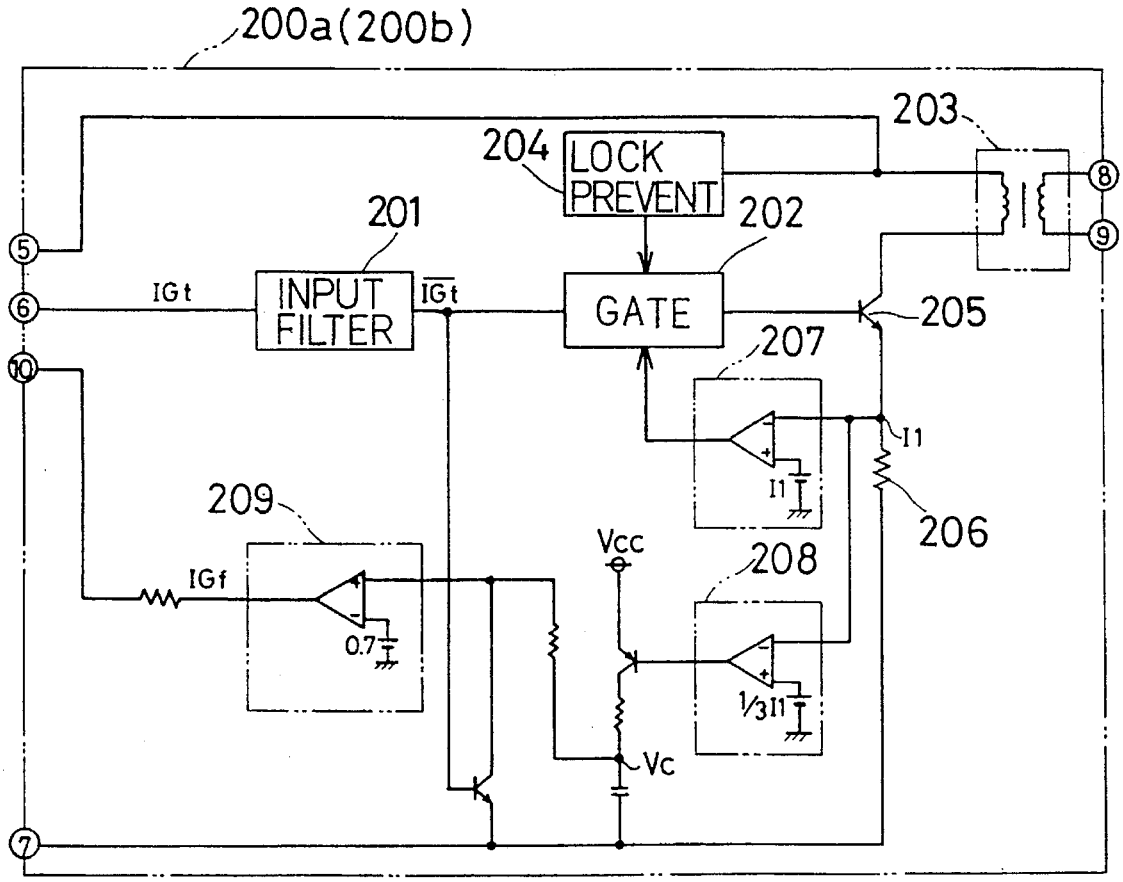
FIG. 26A
FIG. 26B
FIG. 26C
FIG. 26D
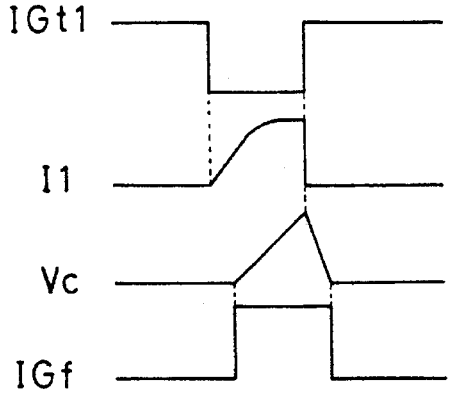

IGNITION APPARATUS FOR INTERNAL COMBUSTION ENGINE

CROSS REFERENCE TO RELATED APPLICATIONS

This application is based on and claims priorities of Japanese Patent Applications No. 6-215139 filed on Sep. 9, 1994 and No. 6-314866 filed on Dec. 19, 1994.

BACKGROUND OF THE INVENTION

1. Field of the Invention

The present invention generally relates to an ignition apparatus for an internal combustion engine. More specifically, the present invention is directed to such an apparatus that an instruction signal for an ignition operation to an ignition coil is produced from a control apparatus for executing an ignition control, and on the other hand, a monitor signal indicative of either a success or a failure of the ignition operation is returned from a circuit made with an ignition coil in an integral form to the control apparatus.

2. Description of the Related Art

Conventionally, as disclosed in Japanese patent application Laid-open (KOKAI DISCLOSURE) No. 64-35078, an arrangement has been proposed that a voltage of an ignition signal is used as a power supply so as to operate an igniter circuit. With employment of this arrangement, since a voltage-regulated output of the control apparatus can be used as the power supply of the igniter circuit, no longer a voltage regulating circuit is employed in the igniter circuit, so that the igniter circuit can be made compact and simple.

On the other hand, in order to determine a failure of an ignition system, it is desired to establish such a system capable of obtaining a monitor signal representative of a success or a failure of an ignition operation. Thus, the system has been proposed in, for instance, Japanese Patent Application Laid-open No. 63-25374, in which the signal for indicating whether or not the primary coil of the ignition coil is energized is returned from the igniter circuit to the control apparatus.

However, in the circuit as proposed in the above-described Japanese Patent Application Laid-open No. 63-25374, the igniter circuit should require an exclusively used power source so as to superimpose the monitor signal on the ignition signal line. As a consequence, there is such a problem that compactness of the circuit scale is incompatible with the response of the monitor signal, which are caused by that the ignition signal is used as the power source.

Also, to obtain monitor signals, many attempts have been made to detect the energizing conditions to the secondary coil of the ignition coil. However, the signal line connected to the secondary coil for producing the high voltage should be connected to the control apparatus. There is another problem of noise resistance characteristics in the case when the very small signal produced by indirectly detecting the energizing current of the secondary coil is deriven up to the control apparatus.

Furthermore, when the energizing condition of the secondary coil to produce the monitor signal, since the monitor signal is returned after the ignition signal is ended, such a problem exists that the monitor signal cannot be discriminated from the ignition signal.

On the other hand, as illustrated in FIG. 24 and FIG. 25, an ignition apparatus for a coil distribution type ignition system for internal combustion engine is conceived as a prior work which detects an occurrence of an ignition failure. FIG. 25 is a detailed circuit diagram for illustrating circuit blocks 200*a* and 200*b* of FIG. 24. FIGS. 26A to 26D are timing charts for representing signal waveforms appearing in various circuit portions of the circuit diagrams shown in FIG. 24 and FIG. 25. This ignition apparatus is so arranged that ignition signals IGt1 and IGt2 corresponding to ignition coils of the respective two cylinders are produced from an ECU 100 to the circuit blocks (coil circuits) 200*a* and 200*b* equal to a coil built in an igniter (namely, igniter is built in coil), and a monitor signal IGf is returned from the circuit blocks 200*a* and 200*b* to the ECU 100.

The ECU 100 is mainly comprised of a microcomputer (MC) 110, a reference power supply Vcc, and the same circuit blocks (current supply) 120*a* and 120*b* corresponding to the ignition coils of the respective two cylinders for the current supply. The circuit blocks 200*a* and 200*b* are mainly constructed of an input filter circuit 201 for performing an input signal process; a gate circuit 202; an ignition coil 203; a lock preventing circuit 204 for forcibly interrupting a primary current of this ignition coil 203 after a preselected time since the primary current of the ignition coil 203 is started to flow; a transistor 205 for causing the primary current of the ignition coil 203 to start to flow; an I1 detecting resistor 206 for detecting the energizing current I1 of the ignition coil 203; a constant current control circuit 207; an energizing current detecting circuit 208; a monitor signal (IGf) waveform shaping circuit 209; and a reference power supply Vcc.

In this ignition apparatus for the internal combustion engine, the terminal numbers 10 of the circuit blocks 200*a* and 200*b* are connected to each other in a halfway of the wiring line through which the monitor signal IGf is returned from the circuit blocks 200*a* and 200*b* to the ECU 100, and are connected to the terminal number 3 of the ECU 100, namely are wired-OR-connected to have a function as a signal line. As a result, a total number of wiring lines may be reduced.

Also, as shown in FIG. 27 and FIG. 28, it is also conceived such an ignition apparatus for the individual cylinder ignition system for internal combustion engine for detecting an occurrence of an ignition failure. FIG. 28 is a detailed circuit diagram for illustrating a circuit block 400 of FIG. 27. This ignition apparatus is so arranged that ignition signals IGt1, IGt2, IGt3 and IGt4 corresponding to ignition coils of the respective cylinders are produced from the ECU 300 to a circuit block (igniter) 400, and the monitor signal IGf is returned from the circuit block 400 to the ECU 300.

The ECU 300 is mainly comprised of a microcomputer 310, a reference power supply Vcc, and four same circuit blocks (C.S.) 320*a*, 320*b*, 320*c* and 320*d* corresponding to the ignition coils of the respective cylinders for the current supply. The circuit block 400 is mainly constructed of an input filter (I.F.) circuit 420 for performing an input signal process; a gate circuit (G) 430; circuit blocks 410*a*, 410*b*, 410*c*, 410*d* having the reference power supply Vcc; an I1 detecting resistor 401 for detecting the monitor signal IGf; a constant current control circuit 402; an IGf detecting circuit 403; a lock preventing circuit 404 for forcibly interrupting primary currents of the ignition coils 500*a*, 500*b*, 500*c*, 500*d* after a preselected time since the primary currents of these ignition coils are started to flow; and a reference power supply Vcc.

In this ignition apparatus for the internal combustion engine, both of the I1 detecting resistor 401 employed in the circuit block 400 and the emitters of the respective transistors connected to the terminal number 22 of the four same circuit blocks 410*a*, 410*b*, 410*c*, 410*d* are commonly connected to each other. As a result a total number of wiring lines for returning the monitor signal IGf to the ECU 300 can be reduced.

In accordance with the ignition apparatus for the internal combustion engine shown in FIG. 24, although this ignition apparatus employs a relatively simple structure, when such a system with no monitor signal IGf is arranged, unnecessary wiring lines are required so as to construct the system with no monitor signal.

On the other hand, in the ignition apparatus for the internal combustion engine as shown in FIG. 27, similar to FIG. 24, it is impossible to realize such an ignition apparatus having the signal line for the monitor signal IGf by employing the same number of wiring lines used in the ignition apparatus without the signal line for the monitor signal IGf.

SUMMARY OF THE INVENTION

The present invention has an object to provide an improved ignition apparatus for an internal combustion engine, capable of producing a monitor signal for detecting ignition failure.

The present invention has another object to provide an ignition apparatus for an internal combustion engine, capable of producing a monitor signal from an energizing state of a secondary coil of an ignition coil, and also capable of returning this monitor signal to a control apparatus with using a less number of wiring lines.

Also, the present invention has another object to prevent an erroneous operation of an igniter circuit by a monitor signal while producing the monitor signal from an energizing state of a secondary coil of an ignition coil.

The present invention has a further object to achieve both conditions such that a circuit scale of an igniter circuit can be made compact by using an ignition signal as a power supply, and a monitor signal is returned.

The present invention has a still further object to prevent an erroneous operation of an igniter circuit in the case that after an ignition signal is ended, a monitor signal is transmitted.

The above-described object of the present invention may be achieved by that energizing information about a secondary coil side of an ignition coil is detected by an igniter circuit built in the igniter coil to produce a monitor signal, this monitor signal is transmitted, and moreover, a mask circuit is employed when the monitor signal is transmitted to an ignition signal terminal, an energizing current to the primary coil is blocked by a semiconductor switching element. With employment of this arrangement, the energizing condition of the secondary coil can be detected by the igniter circuit assembled with the ignition coil in a unit form. The monitor signal utilized to determine an ignition failure in the ignition coil and/or the ignition plug can be obtained by the simple circuit arrangement.

It should be noted that the circuit arrangement can be made compact by employing such a structure that a voltage generated at the secondary coil is transmitted as the monitor signal.

Also, the above-explained objects of the present invention may be achieved by employing such an arrangement that an igniter is operable by using a voltage of an ignition signal as a power supply, and moreover a monitor signal is transmitted while changing a voltage level of this ignition signal. With employment of this arrangement, the igniter circuit assembled with the coil in a unit form can be made compact.

The objects of the present invention may be achieved by employing such an arrangement that a monitor signal is transmitted from an igniter circuit built in a coil via an ignition signal terminal, and a mask circuit for blocking an energizing current to the primary coil by a semiconductor switching element when the monitor signal is transmitted to the ignition signal terminal. With employment of such an arrangement, the monitor signal can be transmitted after the ignition signal is ended, and furthermore an erroneous operation caused by this monitor signal can be prevented.

BRIEF DESCRIPTION OF THE DRAWINGS

In the accompanying drawings:

FIG. 2 is a circuit diagram for representing a detailed circuit block employed in an igniter of FIG. 1;

FIG. 3A to FIG. 3E are timing charts for illustrating signal waveforms appearing at various circuit portions of FIG. 1 and FIG. 2;

FIG. 5A and FIG. 5B are circuit diagrams showing a detailed circuit block employed in the igniter of FIG. 4;

FIG. 6A to FIG. 6F are timing charts illustrating signal waveforms of various circuit portions in FIG. 4 and FIG. 5;

FIG. 16 is a circuit diagram showing a detailed circuit block employed in the igniter of FIG. 15;

FIG. 17A to FIG. 17F are timing charts showing signal waveforms of various circuit portions shown in FIG. 15 and FIG. 16;

FIG. 19 is a circuit diagram showing a detailed circuit block employed in the igniter of FIG. 18;

FIG. 20A to FIG. 20F are timing charts showing signal waveforms of various circuit portions shown in FIG. 18 and FIG. 19;

FIG. 22 is a circuit diagram showing a detailed circuit block employed in the igniter of FIG. 21;

FIG. 23A to FIG. 23F are timing charts showing signal waveforms of various circuit portions shown in FIG. 21 and FIG. 22;

FIG. 25 is a circuit diagram showing a detailed circuit block employed in the igniter of FIG. 24;

FIG. 26A to FIG. 26D are timing charts showing signal waveforms of various circuit portions shown in FIG. 24 and FIG. 25;

DETAILED DESCRIPTION OF THE PREFERRED EMBODIMENTS

The present invention will now be described in detail based upon various embodiments shown in the accompanying drawings.

(FIRST EMBODIMENT)

Figure 1:
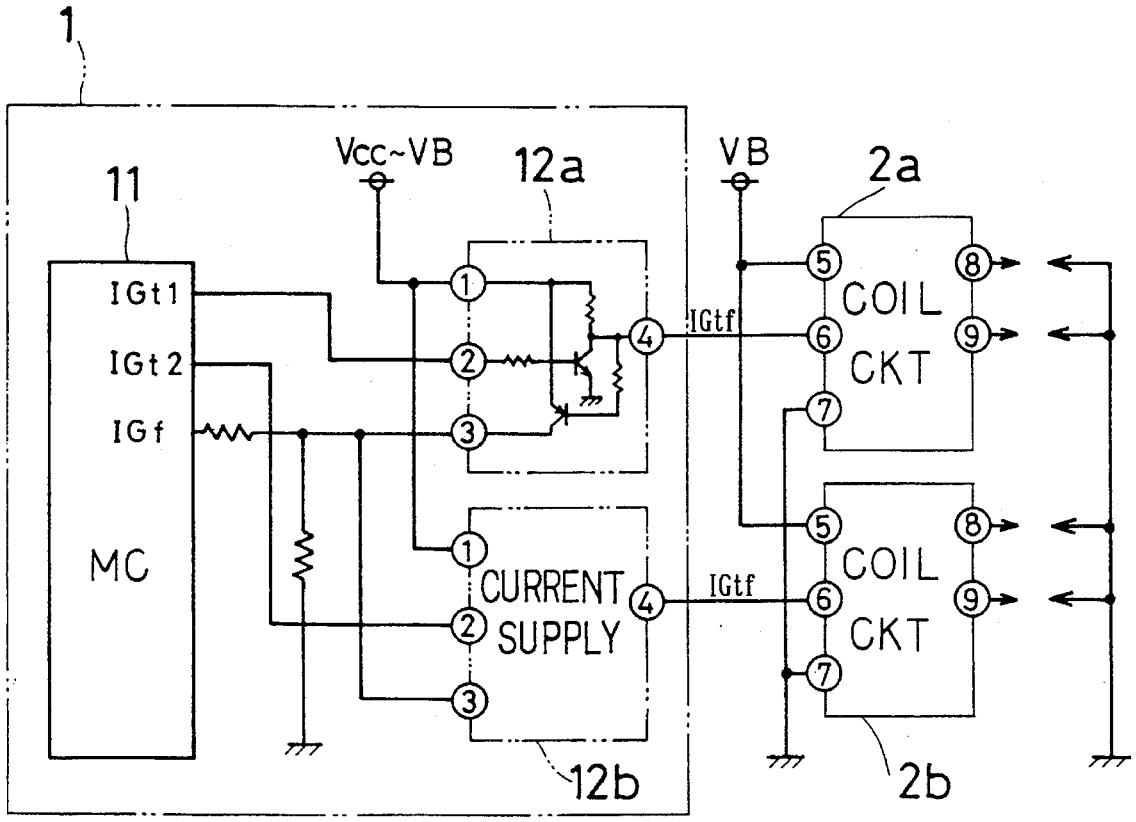
FIG. 1 is a circuit diagram showing an arrangement of a coil distribution ignition system in an ignition apparatus for an internal combustion engine according to a first embodiment of the present invention.

FIG. 1 and FIG. 2 are circuit diagrams showing an arrangement of an ignition apparatus for an internal combustion engine, according to a first preferred embodiment of the present invention. FIG. 2 is a detailed circuit diagram showing circuit blocks (igniter circuits or coil circuits) 2*a* and 2*b* of FIG. 1. FIG. 3A to FIG. 3E are timing charts showing signal waveforms of various circuit portions in the circuits of FIG. 1 and FIG. 2. It should be noted that this embodiment is directed to a coil distribution type ignition apparatus for detecting a failure, used in an internal combustion engine.

This embodiment is so arranged that ignition signals IGt1 and IGt2 corresponding to ignition coils of the respective two cylinders are produced from an ECU 1 to circuit blocks 2*a* and 2*b*, coil circuits with igniters, and a monitor signal IGf is returned from these circuits 2*a* and 2*b* to the ECU 1.

The ECU 1 is mainly constructed of current supply circuit blocks 12*a* and 12*b* identical to each other, a microcomputer 11, a reference power supply Vcc connected to a battery power supply VB. Each of the circuit blocks 2*a* and 2*b* is mainly comprised of, as shown in FIG. 2, a control MIC (igniter signal control monolithic IC) 21 for performing an input signal process and an output signal process; an ignition coil 23; an IGBT 22 for commencing a supply of a primary current to the ignition coil 23; and also an I1 detecting resistor 24 for detecting an energizing current I1 of the primary side of the ignition coil 23. An IGBT means an insulated-gate bipolar transistor, namely a gate circuit of a bipolar transistor is constituted by a low withstanding voltage MOSFET. Furthermore, the control MIC 21 is mainly constructed of resistors R1, R2; a constant current control circuit 211, an IGf detecting circuit 212, a transistor 213, and a reference power supply circuit 214.

In FIG. 1 and FIG. 2, both of ignition signal IGt and monitor signal are transmitted and received via an IGtf line formed by the signal line for these ignition signal IGt and monitor signal IGf based on the above-described basic circuit arrangement. This IGtf line is connected between a terminal number 4 of the circuit blocks 12*a*, 12*b* of the ECU 1, and another terminal number 6 of the circuit blocks 2*a*, 2*b* corresponding to the two ignition plugs. Then, the circuit blocks 2*a* and 2*b* supply the power voltage to the control MIC 21 by using the IGtf line, and the receiving circuit of the ignition signal IGt employs the IGBT 22 functioning as a switching element.

Since the IGBT 22 is used, the resistance values of resistor R1+resistor R2, which are connected to the gate of this IGBT 22, such a level conversion for slightly lowering the voltage level of the gate of this IGBT 22 to return the monitor signal can be easily achieved. Since the battery power supply VB is omitted in the control MIC 21 of this embodiment, protection circuit 65 is not necessary, as compared with the control blocks 6*a* and 6*b* shown in FIG. 8 which will be described later. As to the monitor signal IGf, since the circuit is operable only when the IGtf line corresponding to the power supply line is at the H level, this monitor signal IGf must be returned to the ECU 1 at the same timing as the ignition signal IGt, and the monitor signal IGf can be detected by way of the method for varying the signal level of the ignition signal IGt. As a result, it may be determined by the software of the ECU 1 as to whether or not the monitor signal IGf has been returned to the ECU 1, by comparing the ignition signal IGt produced from the ECU 1 with the monitor signal IGf returned to the ECU 1.

Next, the signal waveforms appearing at the respective circuit portions of FIG. 1 and FIG. 2 will now be explained with reference to the timing charts of FIG. 3A to 3E. It should be noted that both of the circuit block 12*a* of the ECU 1 and the circuit block 2*a* of the igniter side are described.

(1) The level of the IGtf line becomes an H level in response to the ignition signal IGt1 produced from a port IGt1 of the microcomputer 11 of the ECU 1.

(2) Since the level of the IGtf line becomes the H level, the IGBT 22 is turned ON, the primary current I1 is supplied to energize the ignition coil 23, and then the IGf0 signal overlapped with the ignition signal IGt1 at transistor 213 is waveform-shaped from a half way of the ignition signal IGt1 detected by the I1 detecting resistor 24.

(3) The IGf0 signal from current circuit 212 is returned to the IGtf line, and the level of the IGtf line is slightly lowered without completely setting the level of this IGtf line to L (low) level.

(4) The monitor signal IGf inside the ECU 1 can be received, is wired-OR-gated by the circuit block 12*a* within the ECU 1, and thereafter into the port IGf of the microcomputer 11.

(5) The ignition signal IGt1 is discriminated from the monitor signal IGf by the software in the microcomputer 11 to determine an occurrence of an ignition failure.

It should be noted that since the arrangement of this first embodiment is of the primary current detecting type for ignition failure, this arrangement may be also applied to the individual cylinder type ignition system in which one of the secondary current terminals of the ignition coil is connected to the ground line GND.

In this arrangement, both of the signal lines for the ignition signals IGt1, IGt2, and also the signal line for the monitor signal IGf are arranged by the same or single signal line.

In other words, in response to the ignition signals IGt1 and IGt2 for controlling the ignition timings, issued from the ECU 1, the igniter within the circuit blocks 2*a* and 2*b* are driven. The monitor signal IGf of this igniter is detected by failure detecting circuit 21 employed in the circuit blocks 2*a* and 2*b* and then is returned to the ECU 1. Based on this monitor signal IGf, an occurrence of an ignition failure is determined by the ECU 1. In this arrangement, both of the signal lines for the ignition signals IGt1, IGt2, and the signal line for the monitor signal IGf are formed as the same single line which connects the ECU 1 with the igniters employed in the circuit blocks 2*a*, 2*b*. Accordingly, the signal line used to connect between the respective igniters provided within the circuit blocks 2*a*, 2*b*, and the ECU 1 becomes a single line, namely can be made simple.

In accordance with this embodiment, the ignition signals IGt1, IGt2 are overlapped with the monitor signal IGf, and the signal level of the monitor signal IGf is lowered with respect to those of the ignition signals IGt1 and IGt2.

As a consequence, in the case that the ignition signals IGt1 and IGt2 are overlapped with the monitor signal IGf in the time sequential manner, the signal level of the monitor signal IGf is lowered with respect to the ignition signals IGt1 and IGt2. Even when the monitor signal IGf is superimposed on the ignition signals IGt1 and IGt2, the failure determination can be performed.

Furthermore, according to this embodiment, the H level at the signal level of the same line constructed of the IGtf signal line is set as the battery voltage VB, and this signal level is converted. That is to say, the H level in the signal level of the same signal line constructed of the IGtf signal line is set as the battery voltage VB, and this signal level is converted. Since a large voltage difference between the ignition signals IGt1, IGt2 and the monitor signal IGf can be obtained, these signals can be easily discriminated from each other.

In accordance with this embodiment, the ignition signals IGt1 and IGt2 are directly received by the switching element constructed by the IGBT 22. Namely, the ignition signals IGt1 and IGt2 are directly received by the switching element constructed by the IGBT 22, and the circuit arrangement for controlling the primary current of the ignition coil 23 can be made simple.

In addition, according to the ignition apparatus for the internal combustion engine of this embodiment, the same signal line constructed of the IGtf signal line is wired-OR-connected within the ECU 1. In other words, the same signal line constructed of the IGtf signal line is wired-OR-connected within the ECU 1, so that the wiring lines provided within the ECU 1 can be made simple.

The above-described first embodiment in which the respective signal lines for the ignition signal IGt and the monitor signal IGf are made in an integral form will may be modified as shown in FIG. 7 through FIG. 14.

Figure 7:
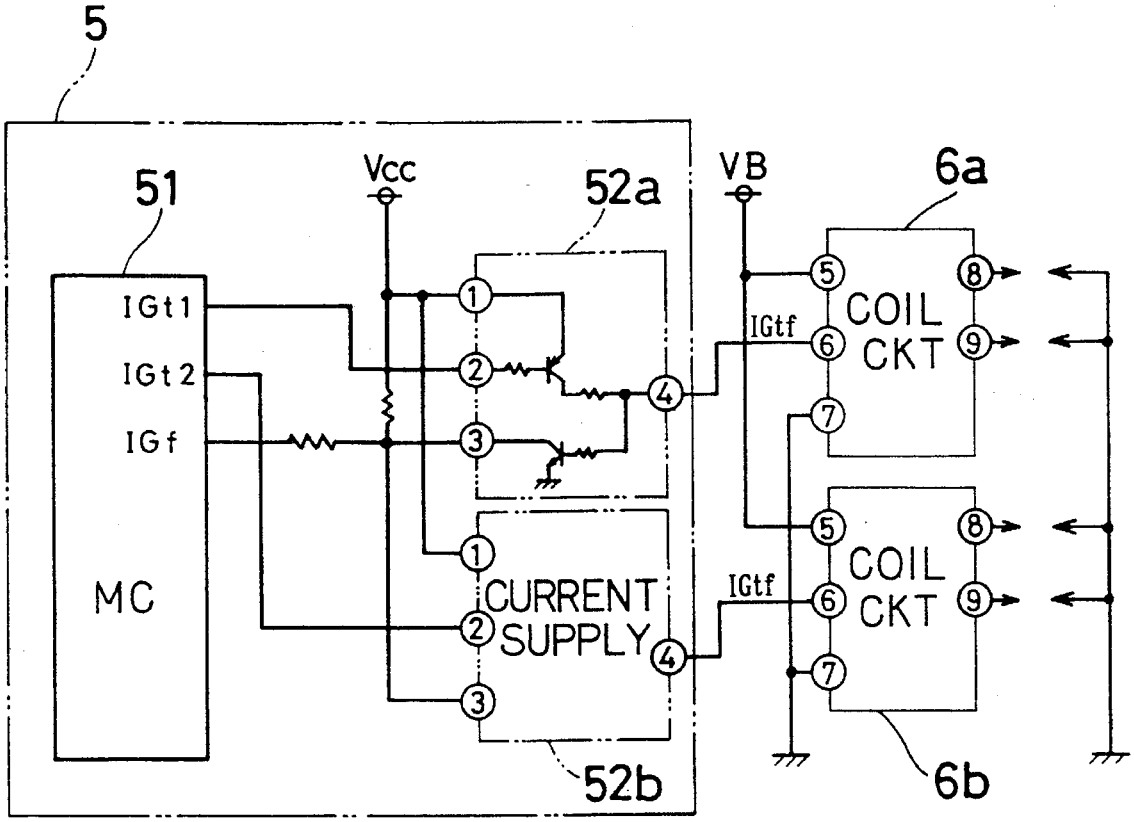
FIG. 7 is a circuit diagram showing a basic circuit arrangement in which signal lines are formed in an integral form in the coil distribution ignition of the ignition apparatus for the internal combustion engine according to a modification of the first embodiment of the present invention.

In FIG. 7, an ECU 5 is comprised of a microcomputer 51 and circuit blocks (input/output circuits or current supply circuits) 52*a* and 52*b*. The microcomputer 51 calculates optimum ignition timings of the engine and produces ignition signals at the terminals IGt1 and IGt2. It also receives the ignition monitor signal IGf to determine operation or failure of the ignition operation. Each of the circuits 52*a* and 52*b* is so constructed as to receive the IGt1 and IGt2 signals at the terminal number 2 and turns off a PNP transistor to produce the ignition control signal from the terminal number 4. On the contrary, its NPN transistor is turned on to receive IGf signal when the signal line IGtf becomes H-level.

Figure 8:
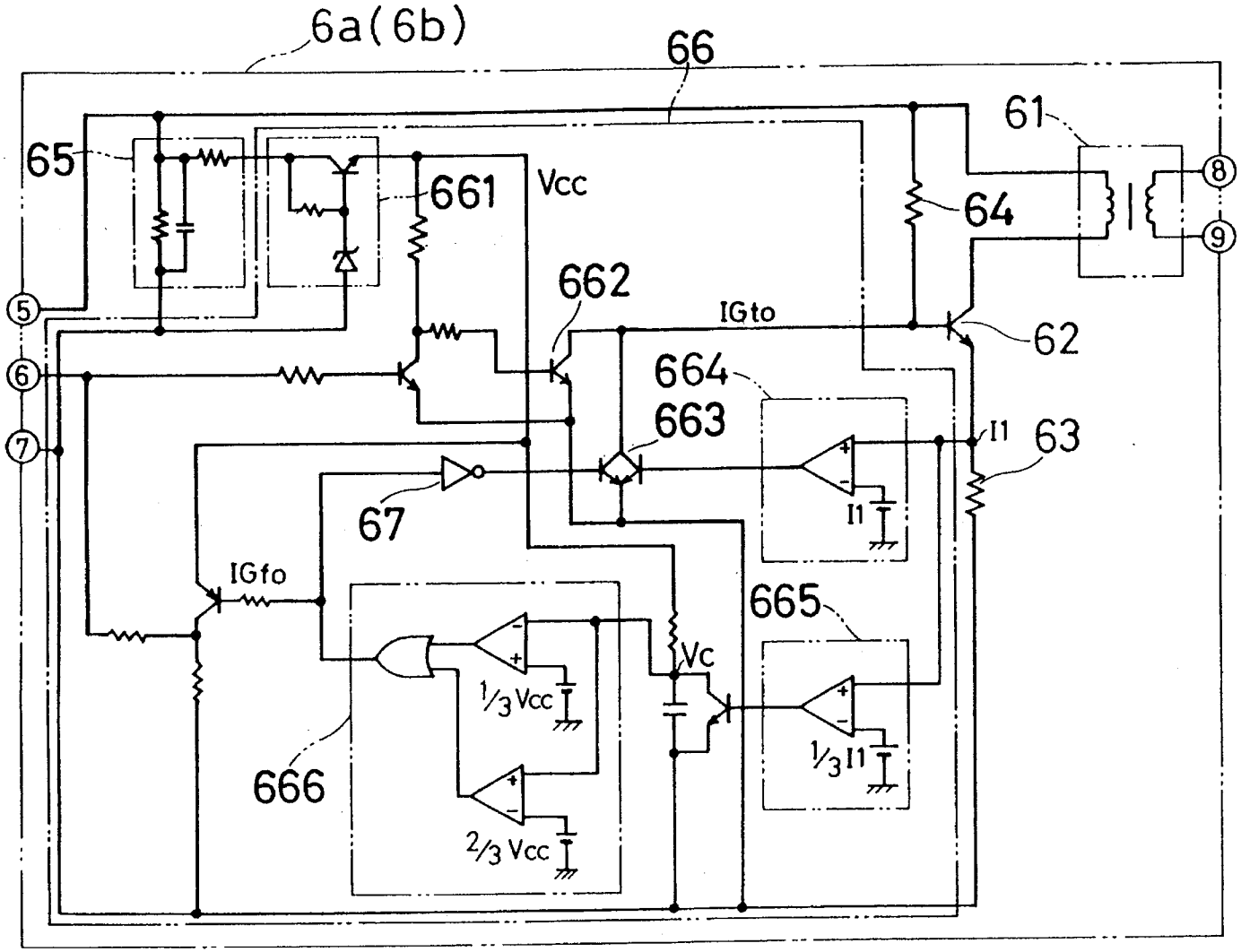
FIG. 8 is a circuit diagram showing a detailed circuit block employed in the igniter of FIG. 7.
Figures 9A, 9B, 9C, 9D, 9E, 9F:
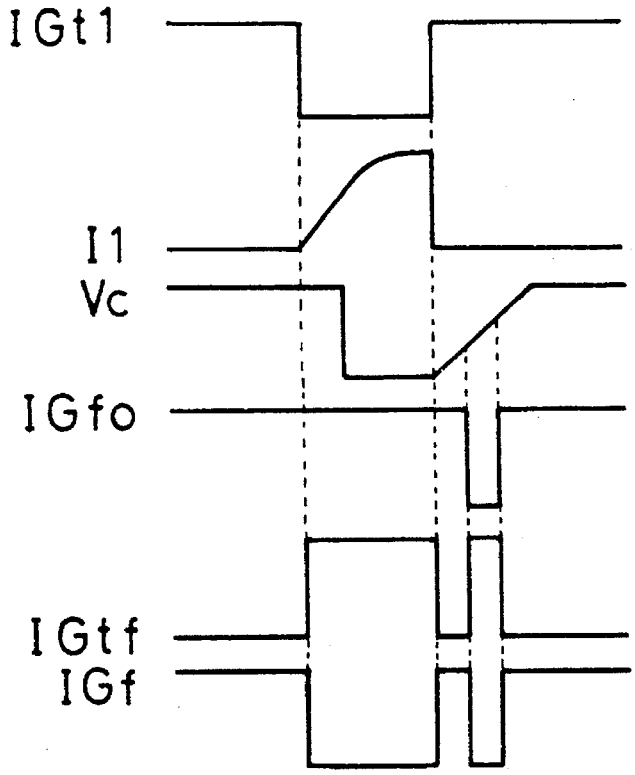
FIG. 9A to FIG. 9F are timing charts illustrating signal waveforms of various circuit portions of FIG. 7 and FIG. 8.

Circuit blocks 6*a* and 6*b* have the same construction. As shown in FIG. 8, the the circuit block 6*a* integrates therein an ignition coil 61 and the igniter which are molded by resin. The ignition coil 61 generates high voltages at the secondary winding thereof and supplies the same to spark plugs mounted on the corresponding engine cylinders. The circuit block 6*a* includes a power supply voltage smoothing circuit 65, MIC circuit 66, a resistor 64, a power transistor 62 and a current detecting resistor 63. The MIC circuit 66 includes a voltage regulator circuit 661, a driving circuit 662 which controls a base potential IGto of the transistor 62 in response to the ignition control signal IGt1 applied to the terminal number 6, and a grounding transistor 663 which forcibly grounds the base potential IGto. Further, the MIC circuit 66 includes a current limiting control circuit 664 which turns on and off transistors 663 and 62 respectively when the current through the resistor 63 exceeds the predetermined value I1, a detection circuit 665 which detects that the current through the resistor 63 exceeds one-third of I1 (I1/3), a monitor signal generating circuit 666 and a mask circuit 67. A delay circuit comprising a resistor, a capacitor and a transistor is connected between the detecting circuit 665 and the monitor signal generating circuit 666, and an amplifier circuit (PNP transistor) is connected to the output side of the monitor signal generating circuit 666.

When the IGt1 signal is produced from the microcomputer 51, the circuit block 52*a* reverses its signal level and applies it to the circuit block 6*a*. As shown in FIGS. 9A through 9F, when the IGt1 signal changes from the H-level to L-level, the power transistor 62 turns on to flow the primary current I1 through the coil 61. At the time the current I1 exceeds the I1/3, the transistor in the delay circuit turns on and the voltage Vc falls. When the IGt1 signal increases from L-level to H-level as the current I1 increases, the primary current is shut off the high voltage is supplied to the two spark plugs from the secondary winding of the ignition coil 61. Thereafter, until the capacitor of the delay circuit is charged gradually and its voltage increases from Vcc/3 to 2 Vcc/3, the IGfo signal is produced to the ignition control signal line from the terminal number 6. At this moment, the mask circuit 67 turns on the grounding transistor 663 so that the power transistor 62 is prevented from being turned on by the IGfo signal. The circuit block 52*a* of the ECU 5 supplies the signal to the microcomputer 51 when the signal line potential is at H-level. The microcomputer 51 determines that the normal ignition operation has been performed, when it receives the IGf signal after sending the IGt1 signal.

Thus, the feature of the modification in FIGS. 7 and 8 are as follows.

(1) The level of the IGtf line becomes H (high) in response to the ignition signals IGt1 and IGt2 produced from preselected ports of a microcomputer 51 of an ECU 5.

(2) The primary current $I_1$ is supplied to energize an ignition coil 61, and an IGf0 signal delayed from the ignition signals IGt1 and IGt2 is waveform-shaped based upon an interrupt signal of this energizing current I1.

(3) An ignition operation failure can be avoided by returning the IGf0 signal to the IGtf line, and at the same time, by masking the IGf0 signal line by a NOT gate 67 corresponding to a logic gate in response to the ignition signal IGt.

(4) The monitor signal IGf returned to the IGtf line is wired-OR-gated within the ECU 5 as a signal delayed from the ignition signals IGt1 and IGt2 by transistors employed in current supply circuit blocks 52*a* and 52*b*.

(5) The ignition signals IGt1 and IGt2 are discriminated from the monitor signal IGf so as to determine an occurrence of a failure by way of a software in the microcomputer 51.

Figure 10:
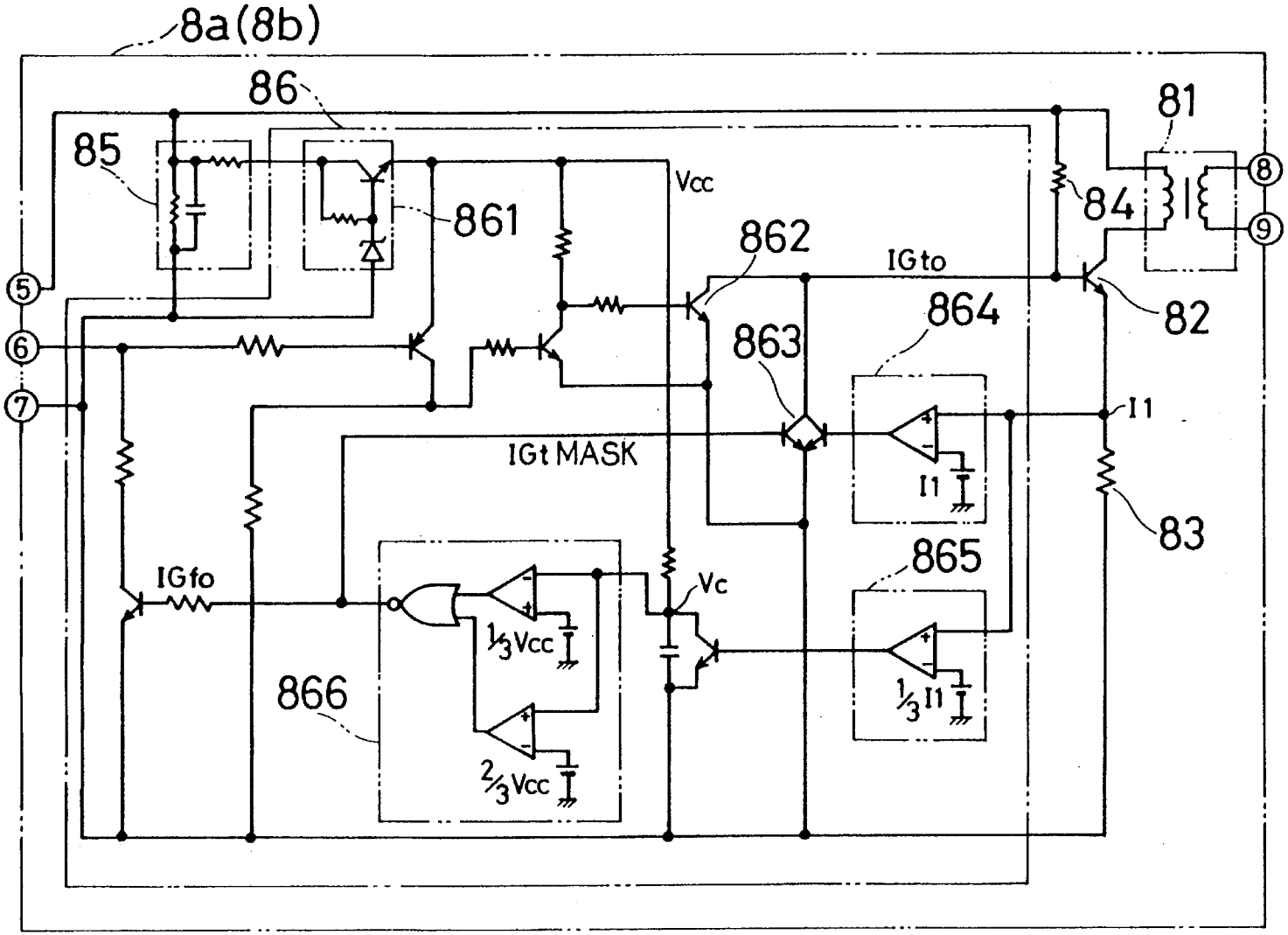
FIG. 10 is a circuit diagram showing in detail a modification of the circuit block employed in the igniter of FIG. 2.
Figures 11A, 11B, 11C, 11D, 11E, 11F:
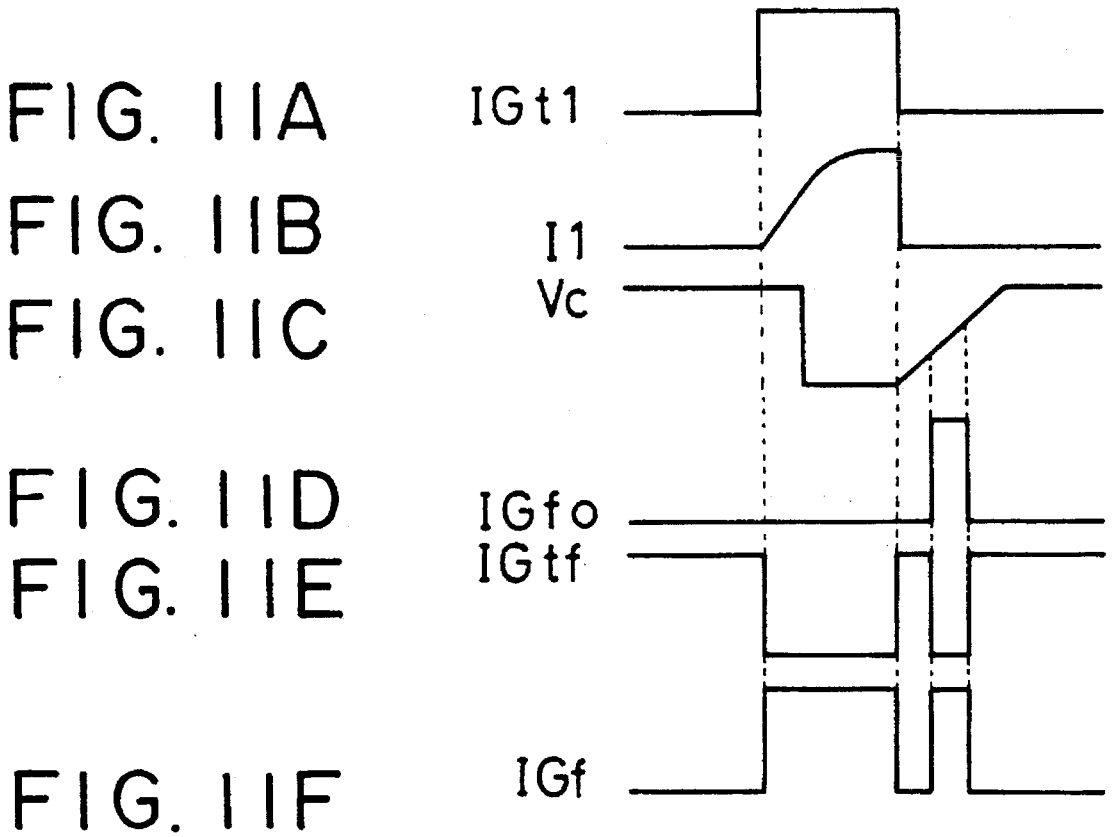
FIG. 11A to FIG. 11F are timing charts illustrating signal waveforms of various circuit portions of FIG. 10.

The circuit configuration of FIG. 8 may be modified as shown in FIG. 10 in which higest digit number 6 of the reference numerals in FIG. 8 is changed to 8 and detailed description of the circuit structure is omitted for brevity. Provided in this modification are a driving circuit 862, a monitor signal generating circuit 866 and an amplifier circuit (NPN transistor) connected to the output side of the circuit 866. This modification is so designed as to flow the primary current I1 when the IGt1 signal is at H-level as shown in FIG. 11A through 11F. It is to be noted that the circuit block 8*a* (8*b*) may be used together with the ECU 1 of FIG. 1.

Figure 12:
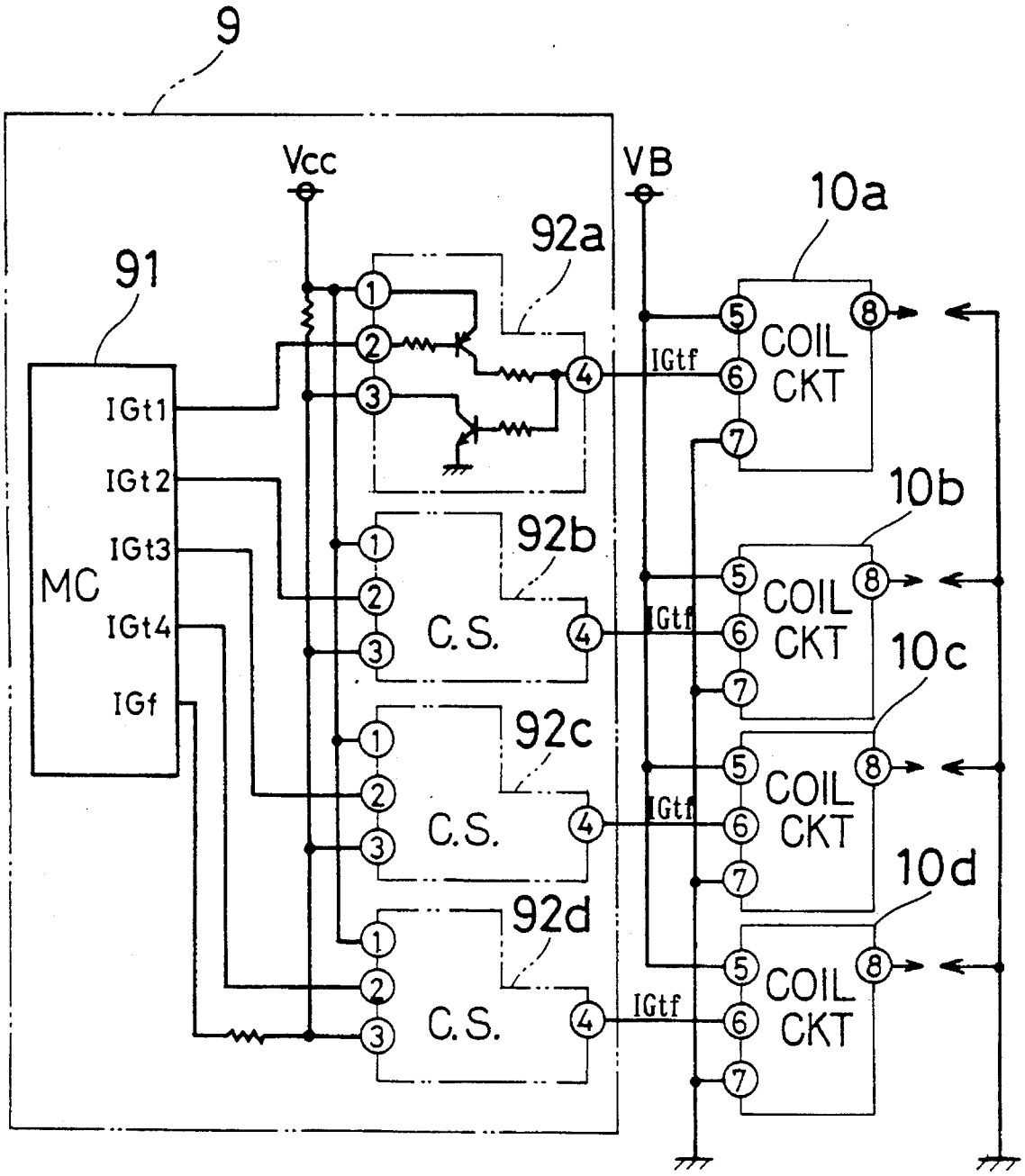
FIG. 12 is a circuit diagram showing a basic circuit arrangement in which signal lines are made in an integral form in the cylindrical type ignition system of the ignition apparatus for the internal combustion engine according to a modification of the second embodiment of the present invention.
Figure 13:
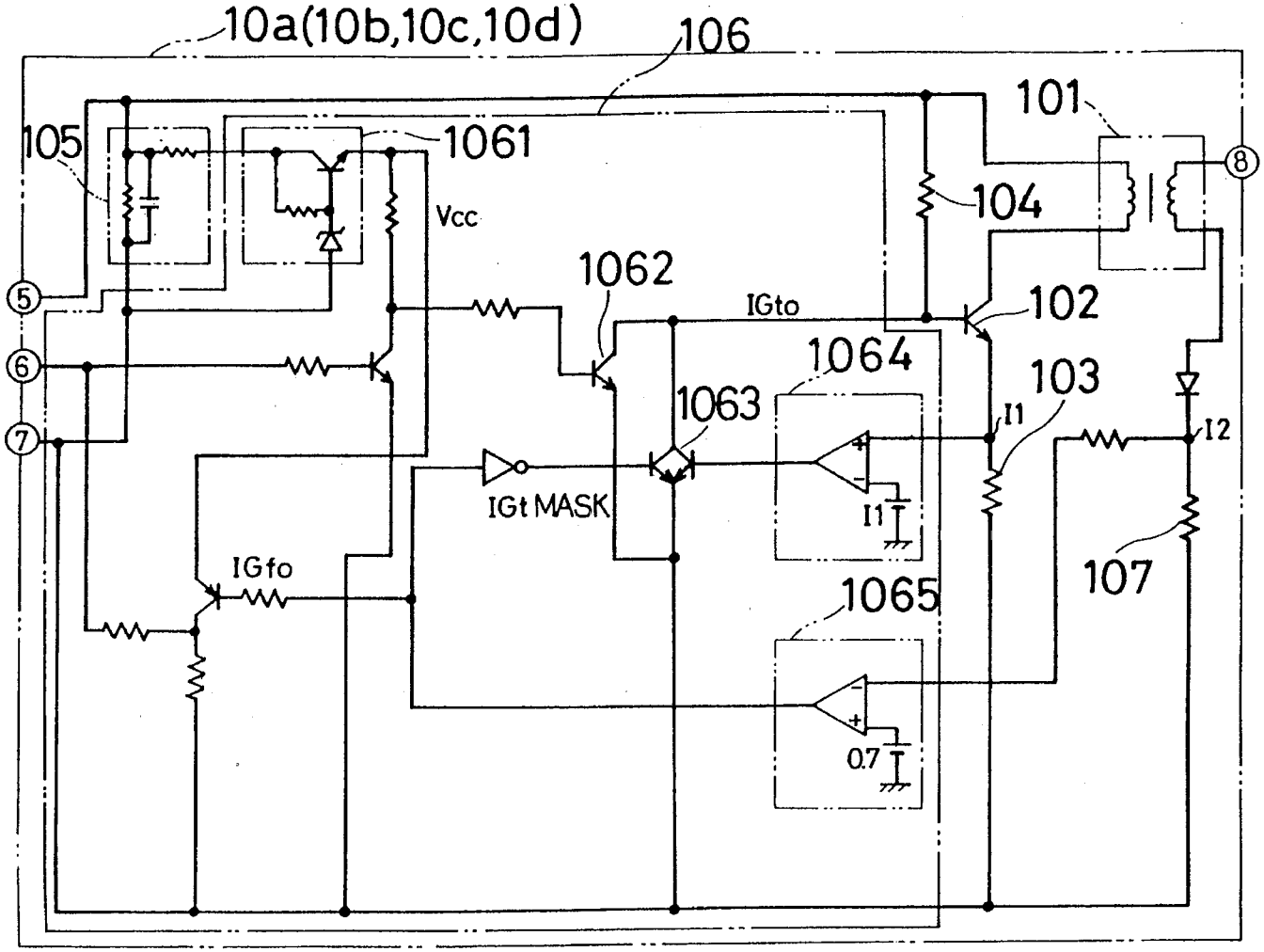
FIG. 13 is a circuit diagram showing a detailed circuit block employed in the igniter of FIG. 12.
Figures 14A, 14B, 14C, 14D, 14E:
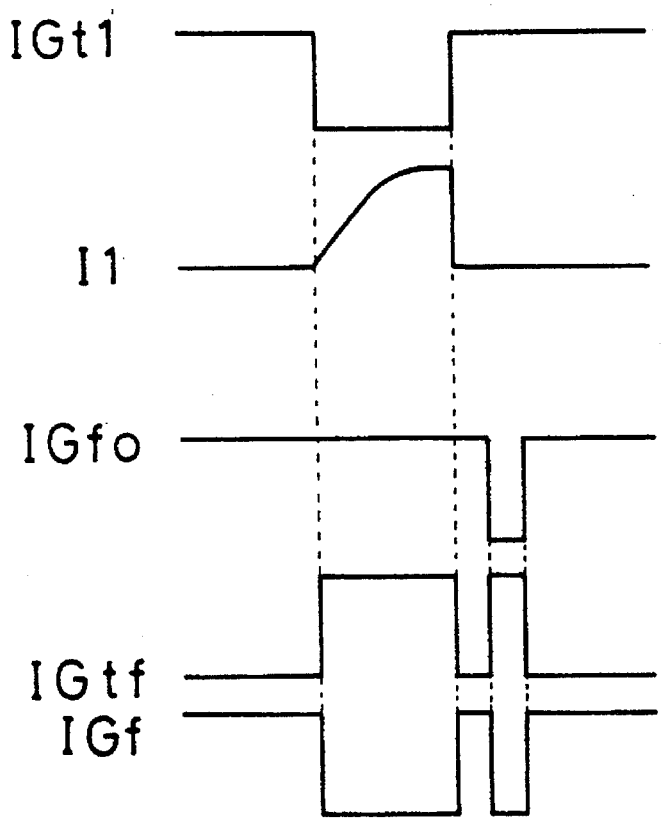
FIG. 14A to FIG. 14E are timing charts for representing signal waveforms of various circuit portions of FIG. 12 and FIG. 13.

As opposed to the modification in FIGS. 7 and 8 in which dual output type ignition coil is used, a single output type ignition coil may be used as a still further modification as shown in FIGS. 12 and 13. In this modification, four circuit blocks 92*a* through 92*d* and four circuit blocks 10*a* through 10*d* are provided, while each of the circuit blocks 92*a* through 92*d* is constructed as in the modification in FIG. 7.

In the circuit block 10*a* (10*b* through 10*d*) which is shown in FIG. 13, the igniter circuit packaged by the use of hybrid integrated circuit technology are integrated with the ignition coil 101 of the single output type in the resin mold. The ignition coil 101 generates the high voltage at one end of its secondary winding and supplies the high voltage to the spark plug. In FIG. 13, the highest digit number 6 of the reference numerals in FIG. 8 is changed to 10 to denote the same or like parts as in FIG. 8 and the detailed description thereof is omitted for brevity. In this modification, however, not only the ignition coil is the single output type but also a secondary current detecting resistor 107 is provided and a monitor signal generating circuit 1065 which produces a monitor signal IGf0 based on the detected secondary current I2. According to this arrangement, as shown in FIG. 14A through FIG. 14E, the secondary current I2 generated after the primary current I1 is shut off is detected by the resistor 107 and the IGf0 signal of H-level is produced as long as the detected current I2 is above a predetermined value.

According to this modification, the monitor signal indicative of normal ignition or ignition failure may be produced based on the secondary current I2 in the coil 101. Further, since the coil 101 and secondary current detecting and processing circuit are integrated into a single block, no long wiring line need be connected to the secondary side of the coil 101 for taking out the secondary current I2. By the integration of electronic circuit with the ignition coil 101 and adjusting the signal level of secondary information such as the current I2 to an appropriate level adapted to electronic circuits, the secondary information may be applied assuredly to the ECU 9 including the microcomputer 91.

(SECOND EMBODIMENT)

Figure 4:
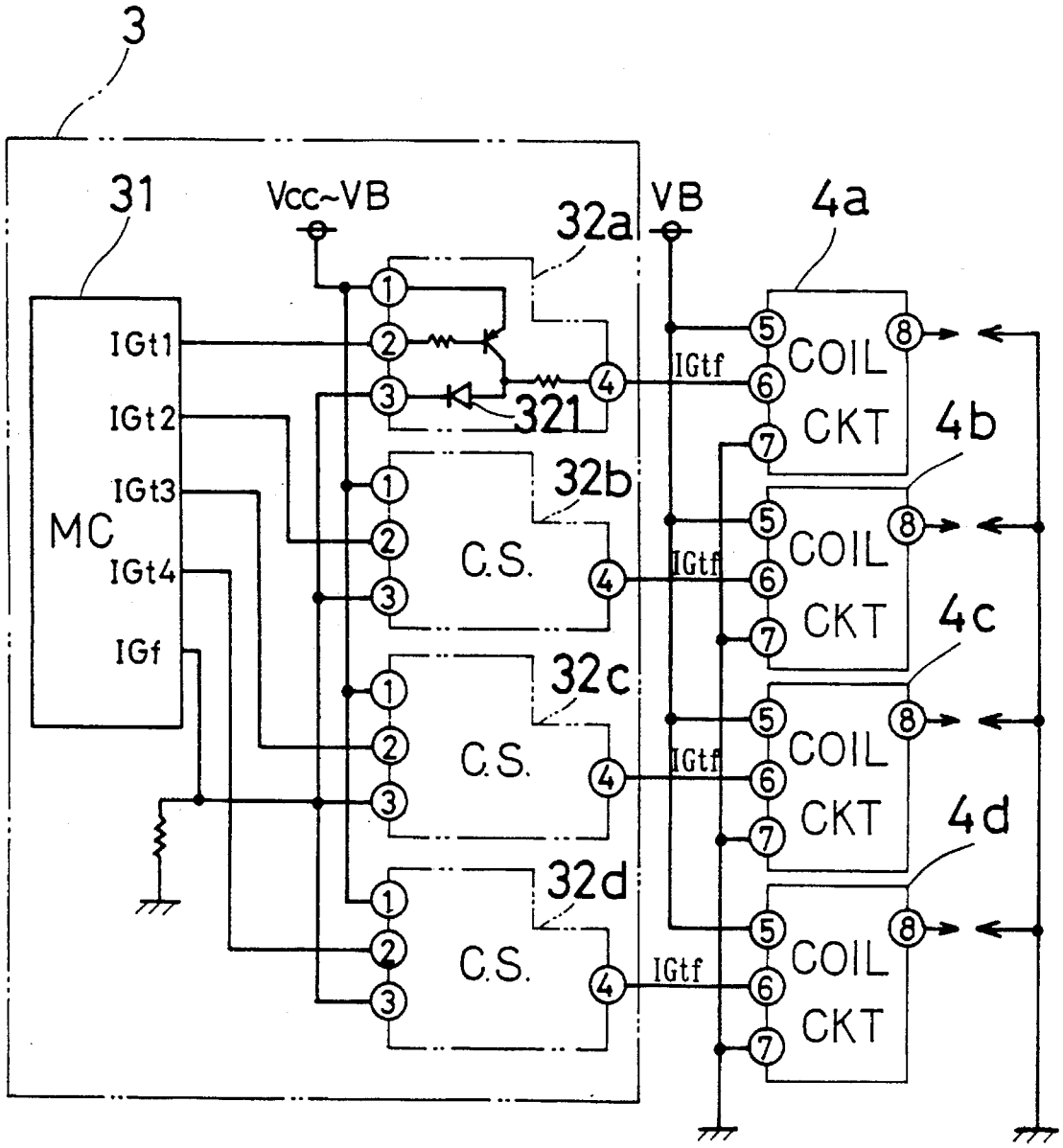
FIG. 4 is a circuit diagram showing an arrangement of a cylinder distribution type ignition system in an ignition apparatus for an internal combustion engine according to a second embodiment of the present invention.
Figure 5B:
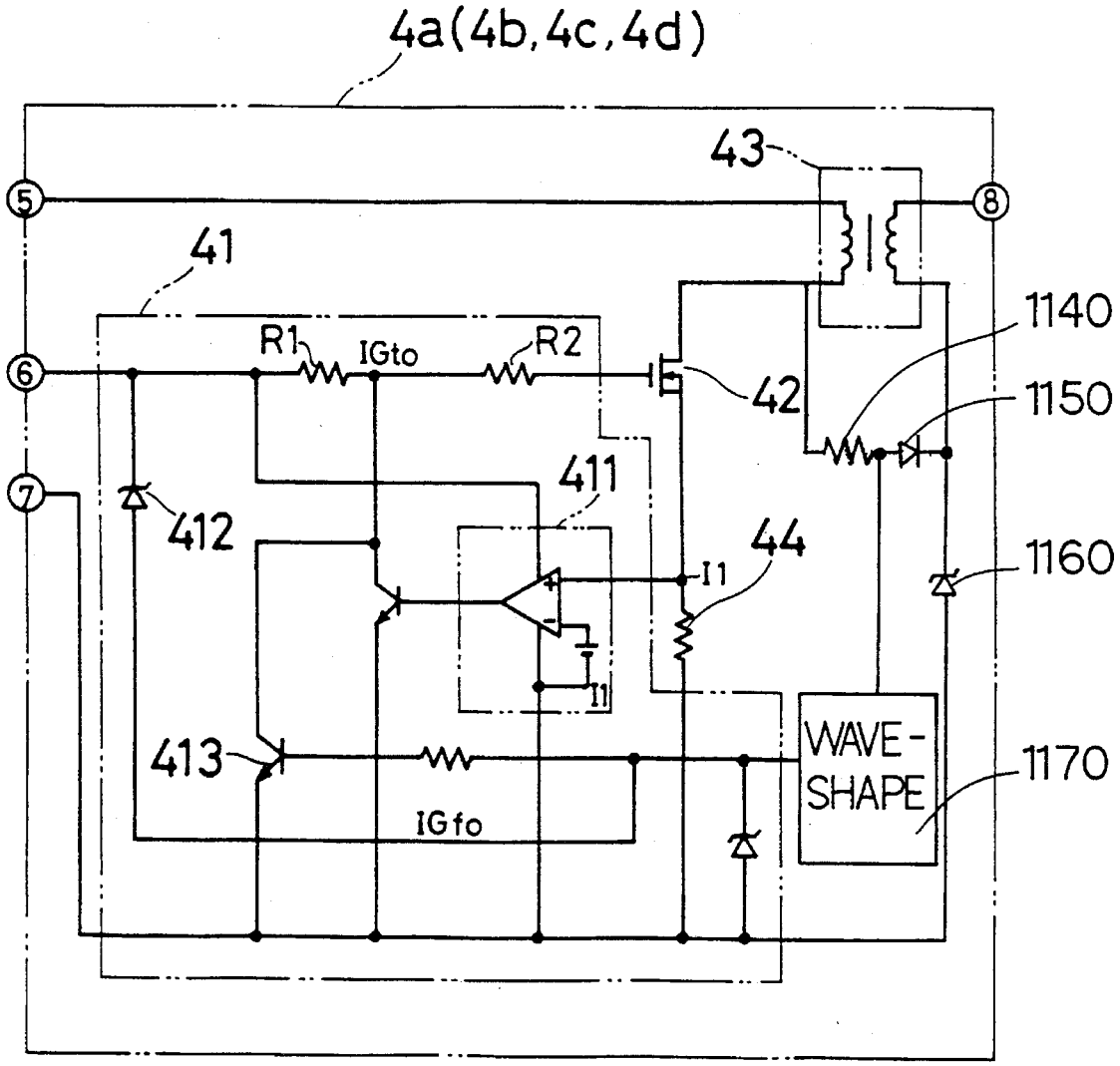

FIG. 4, FIG. 5A and FIG. 5B are circuit diagrams showing an arrangement of an ignition apparatus for an internal combustion engine, according to a second preferred embodiment of the present invention. FIG. 5A is a detailed circuit diagram showing the circuit blocks 4*a*, 4*b*, 4*c* and 4*d* of FIG. 4. FIG. 6A to 6E are timing charts showing signal waveforms of various circuit portions in the circuits of FIG. 4 and FIG. 5A. It should be noted that this embodiment indicates an individual cylinder type ignition apparatus for detecting an ignition failure, used for an internal combustion engine.

This embodiment is so arranged that ignition signals IGt1, IGt2, IGt3 and IGt4 corresponding to ignition coils 43 of the respective cylinders are produced from an ECU 3 to the same circuit blocks (coil circuits with igniters) 4*a*, 4*b*, 4*c* and 4*d*, and a monitor signal IGf is returned from these circuits 4*a*, 4*b*, 4*c* and 4*d* to ECU 3.

The ECU 3 is mainly constructed of a microcomputer 31, a reference power supply Vcc, a battery power supply VB, and the same circuit blocks 32*a*, 32*b*, 32*c*, 32*d* for current supply. The circuit blocks 4*a*, 4*b*, 4*c* and 4*d* are mainly arranged by a control MIC 41 for executing an input signal process and an output signal process; an ignition coil 43; an IGBT 42 for controlling a supply of a primary current of this ignition coil 43; an I1 detecting resistor 44 for detecting the primary energizing current of the ignition coil 43; and an I2 detecting resistor 45 for detecting the secondary energizing current of the ignition coil 43. Further, the control MIC 41 is mainly comprised by resistors R1, R2, a constant current control circuit 411, a zener diode 412 and a transistor 413.

With the above-described basic circuit arrangement, as shown in FIG. 4 and FIG. 5A, both of the ignition signal IGt and the monitor signal IGf are transmitted/received by employing an IGtf signal line constructed of the single signal line for the ignition signal IGt and the monitor signal IGf in an integral form. This IGtf line is to connect two terminals, i.e., a terminal number 4 of the circuit blocks 32*a*, 32*b*, 32*c*, 32*d* of the ECU 3, and a terminal number 6 of the circuit blocks 4*a*, 4*b*, 4*c*, 4*d* corresponding to the respective ignition plugs. Then, in the circuit blocks 4*a*, 4*b*, 4*c*, 4*d*, the power supply to this control MIC 41 is supplied by employing the IGtf signal line, whereas the receiving circuit of the ignition signal IGt employs the IGBT 42 corresponding to the switching element.

This embodiment is for such a case that the ignition signals IGt1, IGt2, IGt3, IGt4 are not overlapped with the monitor signal IGf. When the monitor signal IGf is produced within the igniter constructed by the control MIC 41, the IGBT 42 functioning as the switching element, and the I1 detecting resistor 44 within the circuit blocks 4*a*, 4*b*, 4*c*, 4*d*, the ignition signals IGt1, IGt2, IGt3, IGt4 are not turned ON.

That is to say, in the case that the ignition signals IGt1, IGt2, IGt3, IGt4 are not overlapped with the monitor signal IGf in a time sequential manner, the ignition signal IGt0 side is masked in order not to produce the monitor signal at the same time when the ignition signal IGt0 is turned on in the igniters employed in the circuit blocks 4*a*, 4*b*, 4*c*, 4*d*. As a consequence, it can be avoided that the ignition signals IGt0 are superimposed with the monitor signal IGf.

Next, with reference to timing charts of FIG. 6A to 6F, signal waveforms appearing at various circuit portions of FIG. 4 and FIG. 5A will be described. It should be noted that one of the four cylinders is employed as a typical cylinder in FIG. 6A to FIG. 6F, and both of the circuit block 32*a* and the circuit block 32*b* in the ECU 3 are explained.

(1) The level of the IGtf signal line becomes the H level in response to the ignition signal IGt1 produced from a port IGt1 of the microcomputer 31 of the ECU 3.

(2) Since the level of the IGtf signal line becomes the H level, the IGBT 42 is turned ON to supply the primary current I1 to the ignition coil 43. In response to an interrupt signal of this energizing current I1, a secondary current waveform (which is not overlapped with ignition signal IGt1) delayed from the ignition signal IGt1 detected by the I2 detecting resistor 45 is directly returned as an IGf0 signal corresponding to the monitor signal via the zener diode 412 to the IGtf signal line.

(3) The IGf0 signal is returned to the IGtf signal line, and at the same time, the transistor 413 is turned ON by the IGf0 signal of the secondary current waveform, so that it is masked in order not to increase the potential of the IGt0 signal line, but the IGBT 42 is not turned ON by the returned IGf0 signal. Therefore, an ignition failure can be prevented.

(4) The IGf0 signal returned to the IGtf line is wired-OR-gated as a signal delayed from the ignition signal IGt1 by a diode 321 inside the circuit block 32*a* of the ECU 3, and then the resultant signal is entered into an IGf signal port of the microcomputer 31.

(5) The ignition signal IGt1 is discriminated from the monitor signal IGf by way of the software within the microcomputer 31 to thereby determine an occurrence of an ignition failure.

In accordance with this embodiment, since the circuit is operable only when the signal level of the IGtf line corresponding to the power supply line is at the H level, the circuit is so arranged that the secondary current of the ignition coil 43 is directly returned as the monitor signal IGf to the ECU 3.

The voltages of the power supplies constructed of the reference power supply Vcc to the battery power supply VB are supplied via the signal lines for the ignition signals IGt1, IGt2, IGt3, and further the secondary current I2 of the ignition coil 43 is employed as the DC power supply to transmit the monitor signal IGf.

In other words, the igniters employed in the circuit blocks 4*a*, 4*b*, 4*c*, 4*d* are driven in response to the ignition signal for controlling the ignition timings, derived from the ECU 3. The monitor signal IGf of this igniter is detected by the failure detecting circuits employed in the circuit blocks 4*a*, 4*b*, 4*c*, 4*d* and the detected monitor signal is returned to the ECU 3. Based on this monitor signal IGf, an occurrence of an ignition failure is determined by the ECU 3. The voltage of the power supply constructed of the reference power supply Vcc to the battery power supply VB is applied via the signal lines for the ignition signals IGt1, IGt2, IGt3, IGt4, so that no power source for processing the signals is longer required in the igniters employed in the circuit blocks 4*a*, 4*b*, 4*c*, 4*d*, and also the secondary current of the ignition coil 43 is employed as the DC power supply to transmit the monitor signal IGf. Also, there is no need to newly employ a power supply for transmitting the monitor signal IGf.

This embodiment corresponds to such a case that the ignition signals IGt1, IGt2, IGt3, IGt4 are not overlapped with the monitor signal IGf. When the monitor signal IGf is produced, the ignition signals IGt1, IGt2, IGt3, IGt4 are not turned ON within the igniter constructed of the control MIC 41 within the circuit blocks 4*a*, 4*b*, 4*c*, 4*d*, the IGBT 42 functioning as the switching element, and the I1 detecting resistor 44. As a consequence, when the ignition signals IGt1, IGt2, IGt3, IGt4 are not overlapped with the monitor signal IGf in a time sequential manner, if the monitor signal IGf is produced within the igniter employed in the circuit blocks 4*c*, 4*b*, 4*c*, 4*d*, then the ignition signals IGt1, IGt2, IGt3, IGt4 are turned ON and are not simultaneously produced by masking the ignition signal. Therefore, the ignition signals IGt1, IGt2, IGt3, IGt4 are not superimposed on the monitor signal IGf.

Then, according to this embodiment, the ignition coil 43 is built in the igniter constructed by the control MIC 41 within the circuit blocks 4*a*, 4*b*, 4*c*, 4*d*, the IGBT 42 corresponding to the switching element, and the I1 detecting resistor 44. As a consequence, the ignition coil 43 is built in the igniter employed in the circuit blocks 4*a*, 4*b*, 4*c*, 4*d*, and the simple wiring connection can be established between the ignition coil 43 and the igniter employed in the circuit blocks 4*a*, 4*b*, 4*c*, 4*d*.

Furthermore, according to this embodiment, the monitor signal IGf is transmitted via the zener diode 412 provided in the control MIC 41 employed in the circuit blocks 4*a*, 4*b*, 4*c* and 4*d*. Accordingly, the monitor signal is transmitted via the zener diode 412 employed in the circuit blocks 4*a*, 4*b*, 4*c*, 4*d*, and the monitor signal IGf can be surely transmitted to the side of ECU 3 irrespectively to such a fact whether or not the ignition signals IGt1, IGt2, IGt3, IGt4 are present.

On the other hand, since the waveform of the monitor signal IGf appearing on the IGtf signal line is the secondary current waveform in the arrangement of this embodiment, if the signals on the IGtf line are directly taken in as an A/D-converted value into the port IGf of the microcomputer 31, then the secondary current waveform value flowing through the ignition plug can be recognized by the microcomputer 31. When such a secondary current waveform which flows through the ignition plug is performed by the microcomputer 31, there are other advantages that the discharge voltage at the ignition plug can be predicted, and such a shortcircuit mode as a plug surface leakage can be detected.

A modification of this second embodiment may be realized as illustrated in FIG. 5B. As shown in FIG. 5B a voltage is applied from a power supply terminal number 5 via a resistor 1140 and a diode 1150 to the lower voltage side of the secondary coil. Then, a signal is derived from a junction point between the resistor 1140 and the diode 1150, and this signal is amplified by a waveform shaping circuit 1170 to produce a monitor signal. With this circuit arrangement, an ion current flowing through the electrode of the ignition plug, caused by combustion just after an ignition, is detected as a current flowing through the secondary coil of the ignition coil 43, and then a monitor signal is produced based on this ion current. It should be noted that a zener diode 1160 is employed so as to limit the current energizing direction.

Then, this monitor signal IGfo is transmitted via a diode 412 to an ignition signal terminal number 6 and causes the transistor 413 to become conductive, so that erroneous operations of the IGBT 42 in response to the monitor signal can be prevented.

In the individual cylinder type ignition system shown in FIG. 12 and FIG. 13 as a further modification, although the signal waveforms of the timing charts shown in FIG. 14A to 14E are substantially equal to those of the timing charts shown in FIG. 9A to FIG. 9F corresponding to the embodiment of FIG. 7 and FIG. 8, there is such a feature of the individual cylinder type ignition system that the positive terminal of the secondary coil side of the ignition coil 101 can be connected to the GND line. Also, since the positive terminal of the secondary coil side of the ignition coil 101 corresponding to the coil contained in the igniter can be readily connected to the ground line, the monitor signal IGf is detected based on the secondary current I2 of the ignition coil 101. Thus, the detection mode of the ignition failure can be improved, as compared with the detection mode of the primary current $I_1$.

(THIRD EMBODIMENT)

Figure 15:
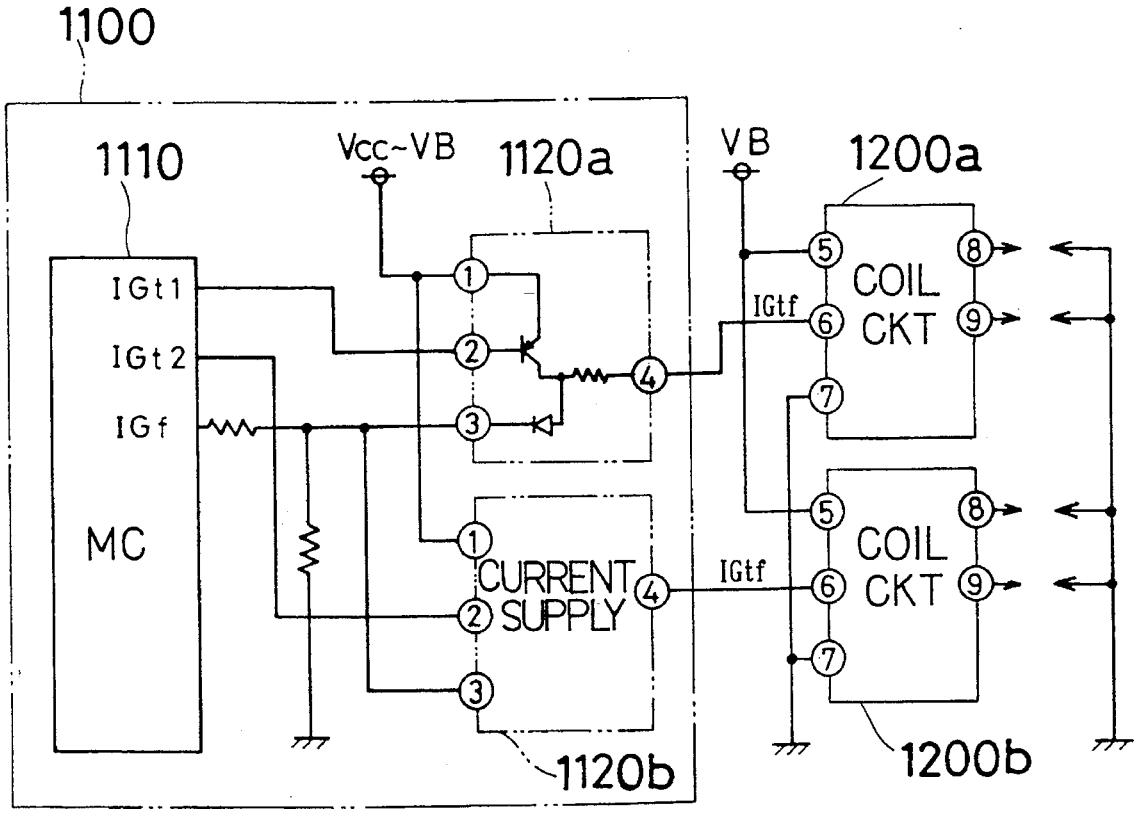
FIG. 15 is a circuit diagram showing an arrangement of a coil distribute ignition system in an ignition apparatus for an internal combustion engine according to a third embodiment of the present invention.

FIG. 15 is a circuit diagram showing an arrangement of an ignition apparatus for an internal combustion engine according to a third embodiment of the present invention. FIG. 16 is a detailed circuit diagram showing circuit blocks 1200*a* and 1200*b* of FIG. 15. FIG. 17A to FIG. 17F are timing charts showing signal waveforms appearing at various circuit portions in the circuit diagrams of FIG. 15 and FIG. 16. In this embodiment, there is shown an ignition apparatus for a coil distribution type ignition apparatus for internal combustion engine which may detect an occurrence of an ignition failure.

The present embodiment is so arranged that ignition signals IGt1 and IGt2 corresponding to ignition coils of the respective two cylinders are produced from an ECU 1100 to the same circuit blocks 1200*a* and 1200*b* corresponding to coil circuits 1200*a* and 1200*b*, and a monitor signal IGf is returned from these coil circuits 1200*a* and 1200*b* to the ECU 1100.

The ECU 1100 is mainly constructed of a microcomputer 1110, a reference power supply Vcc to a battery power supply VB, and the same circuit blocks 1120*a*, 1120*b* for current supply. The circuit blocks 1200*a* and 1200*b* are mainly constructed by a control MIC 1201 for executing an input signal process and an output signal process; an ignition coil 1203; an IGBT 1202 for controlling a supply of a primary current of this ignition coil 1203; an I1 detecting resistor 1204 for detecting the primary energizing current I1 of the ignition coil 1203; a third winding 1230 as an auxiliary winding for an ignition coil 1203 constructed of a primary winding and a secondary winding; and an I2 detecting resistor 1205 for detecting an energizing current I2 for the third winding side of this third winding 1230. Further, the control MIC 1201 is mainly constructed by resistors R1, R2, a constant current control circuit 1210, a zener diode 1211 and a transistor 1212.

With the above-described basic circuit arrangement, as shown in FIG. 15 and FIG. 16, both of the ignition signal IGt and the monitor signal IGf are transmitted/received by a single IGtf signal line for the ignition signal IGt and the monitor signal IGf. This IGtf line is to connect between terminals, i.e., a terminal number 4 of the circuit blocks 1120*a*, 1120*b* of the ECU 1100, and a terminal number 6 of the circuit blocks 1200*a*, 1200*b* corresponding to the respective two ignition plugs. Then, in the circuit blocks 1200*a* and 1200*b*, the power to this control MIC 1201 is supplied by employing the IGtf signal line, whereas the receiving circuit of the ignition signal IGt employs the IGBT 1202 corresponding to the switching element.

A portion of the secondary current flowing through the secondary winding of the ignition coil 1203 may be obtained by way of an I2 detecting resistor 1205 functioning as a voltage dividing resistor, and also the third winding 1230. In accordance with the ignition apparatus for the coil distribution type internal combustion engine with using this third winding 1230, the quasi-secondary current waveform may be utilized as the power supply.

Timing charts of FIG. 17A to FIG. 17F are similar to that of FIG. 6A to 6F in the above-described second embodiment, and a detailed explanation thereof is omitted. As a consequence, it can be seen that the ignition apparatus for such an internal combustion engine that the quasi-secondary current waveform obtained by utilizing the third winding of this embodiment is used as the power source, may be realized in the individual cylinder ignition type internal combustion engine according to the second embodiment.

In other words the igniters employed in the circuit blocks 1200*a* and 1200*b* are driven in response to the ignition signals IGt1 and IGt2 for controlling the ignition timings, derived from the ECU 1100. The monitor signal IGf of this igniter is detected by the failure detecting circuits employed in the circuit blocks 1200*a* and 1200*b*, and the detected monitor signal is returned to the ECU 1100. Based on this monitor signal IGf, an occurrence of an ignition failure is determined by the ECU 1100. The signal lines for the ignition signals IGt1 and IGt2, which connect the ECU 1100 with the igniters employed in the circuit blocks 1200*a* and 1200*b*, and further the signal line for the monitor signal IGf are made of the same signal line corresponding to the IGtf signal line. Also, the wiring line for connecting among the ECU 1100 and the igniters in the circuit blocks 1200*a* and 1200*b* can be made as a single line, i.e., simple.

Also, since the monitor signal IGf is produced from the third winding 1230 of the ignition coil 1203, such information that the ignition plug has electrically discharged by way of the ignition coil 1203 can be returned as the monitor signal IGf to the ECU 1100. As a consequence, in the arrangement of this third embodiment, similar to the second embodiment, if the signals on the IGtf line are directly taken in as an A/D converted value into the port IGf of the microcomputer 1110, then the secondary current waveform flowing through the ignition plug can be recognized by the microcomputer 1110. When such a secondary current waveform which flows through the ignition plug is performed by the microcomputer 1110, there are other advantages that the discharge voltage at the ignition plug can be predicted, and such a short circuit mode as a plug surface leakage can be detected.

(FOURTH EMBODIMENT)

Figure 18:
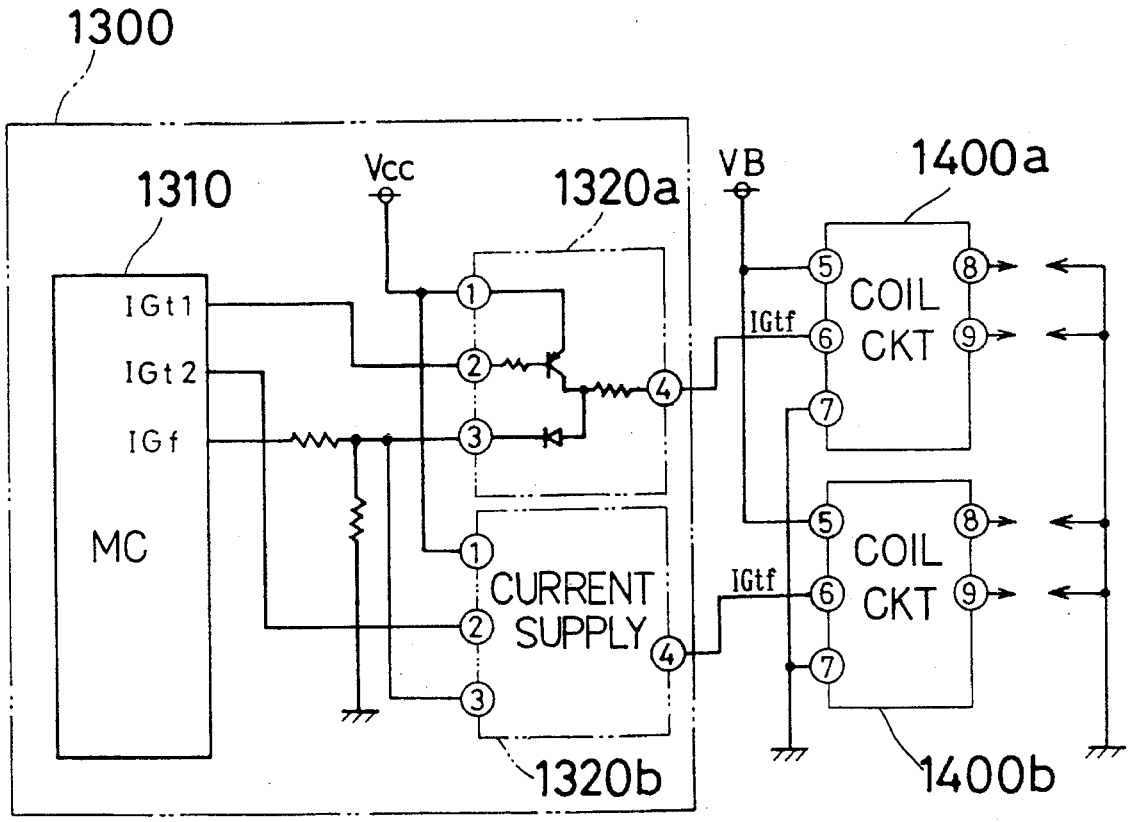
FIG. 18 is a circuit diagram showing an arrangement of a coil distribution ignition system in an ignition apparatus for an internal combustion engine according to a fourth embodiment of the present invention.

FIG. 18 and FIG. 19 are circuit diagrams showing an arrangement of an ignition apparatus for an internal combustion engine according to a fourth embodiment of the present invention. FIG. 19 is a detailed circuit diagram showing circuit blocks 1400*a* and 1400*b* of FIG. 18. FIG. 20A to FIG. 20F are timing charts showing signal waveforms appearing at various circuit portions in the circuit diagrams of FIG. 18 and FIG. 19. In this embodiment, there is shown an ignition apparatus for a coil distribution ignition type internal combustion engine which may detect an occurrence of an ignition failure.

The present embodiment is so arranged that ignition signals IGt1 and IGt2 corresponding to ignition coils of the respective two cylinders are produced from an ECU 1300 to the same circuit blocks 1400*a* and 1400*b*, and a monitor signal $IG_f$ is returned from these circuits 1400*a* and 1400*b* to the ECU 1300.

The ECU 1300 is mainly constructed of a microcomputer 1310, a reference power supply Vcc to a battery power supply VB, and the same circuit blocks 1320*a* and 1320*b* for current supply. The circuit blocks 1400*a* and 1400*b* are mainly constructed by a control MIC 1401 for executing an input signal process and an output signal process; an ignition coil 1403; an IGBT 1402 for controlling a supply of a primary current of this ignition coil 1403; an I1 detecting resistor 1404 for detecting the primary energizing current of the ignition coil 1403; and a V1 detecting resistor 1405 for detecting a primary voltage V1 by way of a voltage dividing resistor and a primary winding of the ignition coil 1403. Further, the control MIC 1401 is mainly constructed by resistors R1, R2, a constant current control circuit 1410, a zener diode 1411 and a transistor 1412.

With the above-described basic circuit arrangement, as shown in FIG. 18 and FIG. 19, both of the ignition signal IGt and the monitor signal IGf are transmitted/received by employing an IGtf signal line constructed of a single line for the ignition signal IGt and for the monitor signal IGf. This IGtf line is to connect terminals, i.e., a terminal number 4 of the circuit blocks 1320*a* and 1320*b* of the ECU 1300 and a terminal number 6 of the circuit blocks 1320*a* and 1320*b* corresponding to the respective ignition plugs. Then, in the circuit blocks 1400*a* and 1400*b*, the power to this control MIC 1401 is supplied by employing the IGtf signal line, whereas the receiving circuit of the ignition signal IGt employs the IGBT 1402 corresponding to the switching element.

As indicated in timing charts of FIG. 20A to FIG. 20F, since the primary voltage V1 is utilized as the own power supply also in the ignition apparatus for the internal combustion engine with this arrangement, although such information that the ignition plug has electrically discharged cannot be returned from the ignition coil 1403 to the ECU 1300 as the monitor signal IGf, at least another information that the ignition coil 1403 has charged the magnetic energy can be returned as the monitor signal IGf to the ECU 1300.

The signal line for the ignition signals IGt1 and IGt2, and the signal line for the monitor signal IGf are constructed of the same signal line from the IGtf signal line, and also the monitor signal IGf is produced from the primary voltage V1 generated based on the leakage inductance on the primary side.

In other words, the igniters employed in the circuit blocks 1400*a* and 1400*b* are driven in response to the ignition signals IGt1 and IGt2 for controlling the ignition timings, derived from the ECU 1300. The monitor signal IGf of this igniter is detected by the monitor detecting circuits employed in the circuit blocks 1400*a* and 1400*b* and the detected monitor signal is returned to the ECU 1300. Based on this monitor signal IGf, an occurrence of an ignition failure is determined by the ECU 1300. The signal line of the ignition signals IGt1 and IGt2, which connect the ECU 1300 employed in this arrangement with the igniters employed in the circuit blocks 1400*a* and 1400*b*, and also the signal line of the monitor signal IGf are made of the same signal line of the IGtf signal line. Also, the wiring line for connecting the ECU 1300 with the respective igniters employed in the circuit blocks 1400*a* and 1400*b* becomes a single line, and thus can be simplified. Further, such information that the ignition coil 1403 has charged the magnetic energy can be returned as the monitor signal IGf to the ECU 1300.

According to the present embodiment, the monitor signal IGf is produced by employing the resistance member constructed of the V1 detecting resistor 1405 for dividing the primary voltage of the ignition coil 1403. As a consequence, the information about the primary voltage V1 applied to the primary winding of the ignition coil 1403 is detected by the V1 detecting resistor 1405, and the detected information can be transmitted through the IGtf line and can be returned as the monitor signal IGf to the ECU 1300.

(FIFTH EMBODIMENT)

Figure 21:
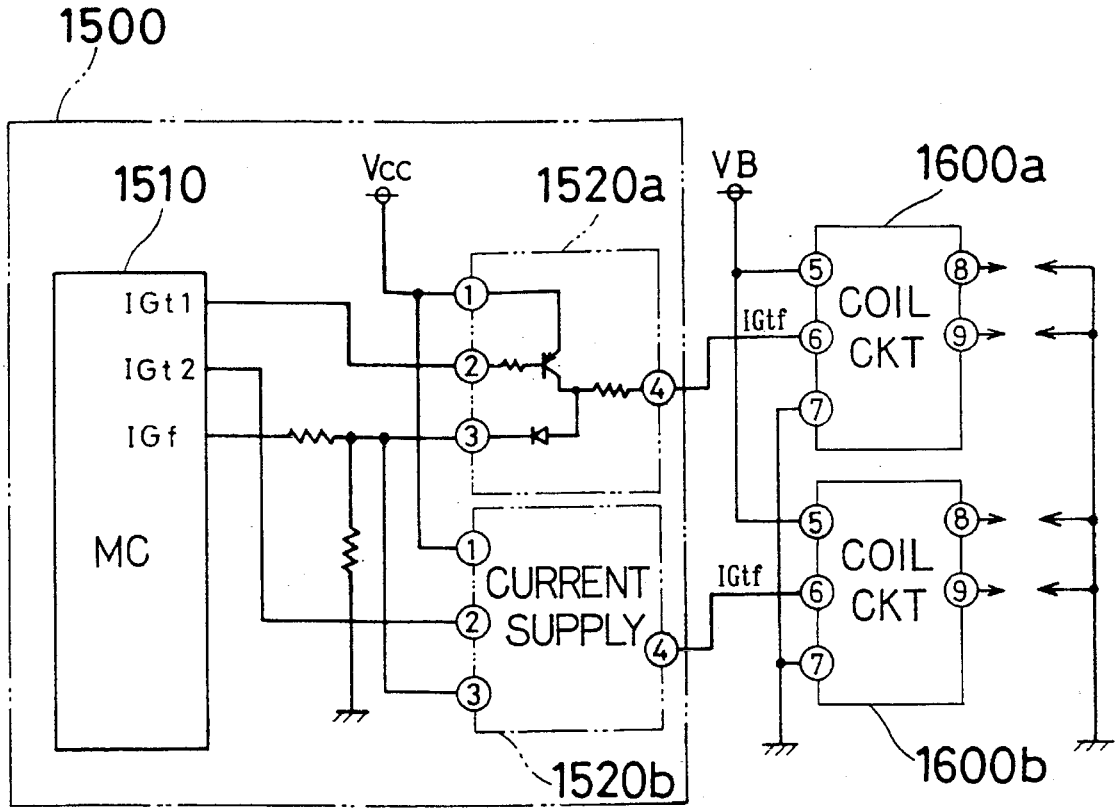
FIG. 21 is a circuit diagram showing an arrangement of a coil distribution ignition system in an ignition apparatus for an internal combustion engine according to a fifth embodiment of the present invention.
Figure 24:
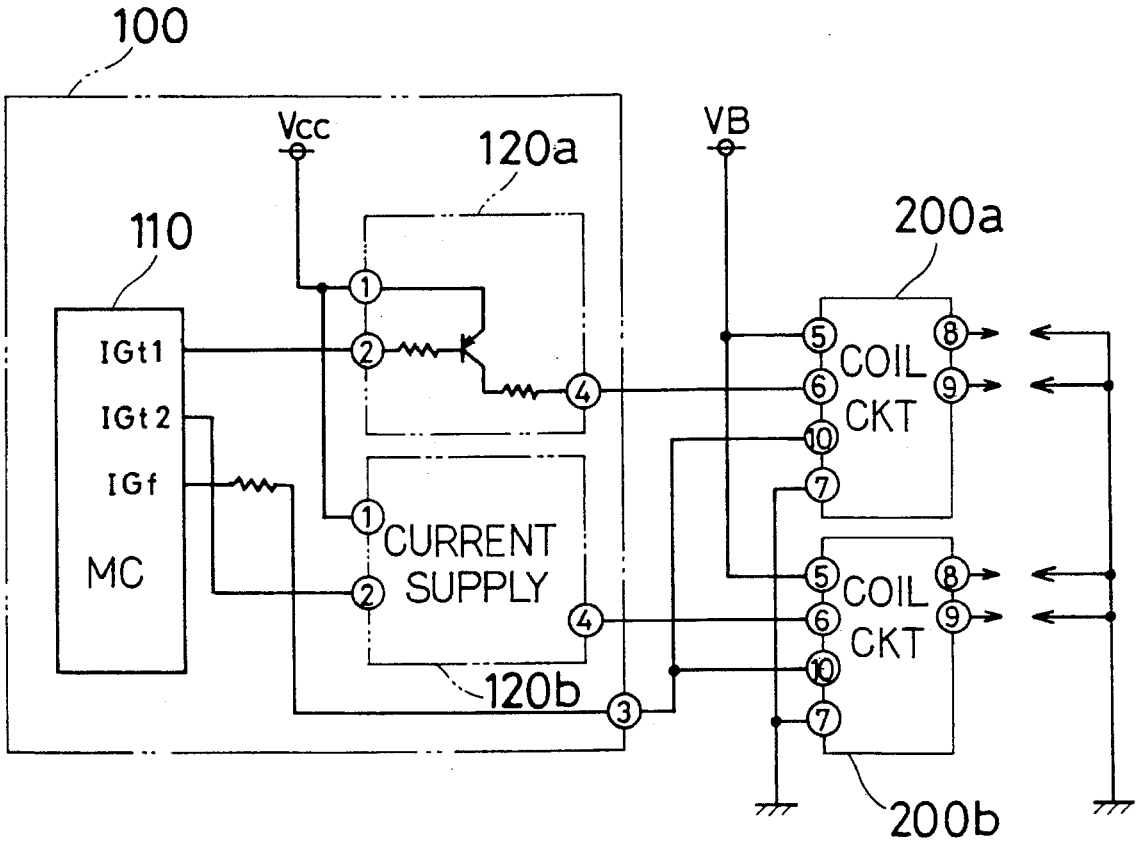
FIG. 24 is a circuit diagram showing an arrangement of a coil distribution ignition system in an ignition apparatus for an internal combustion engine according to one prior work.
Figure 27:
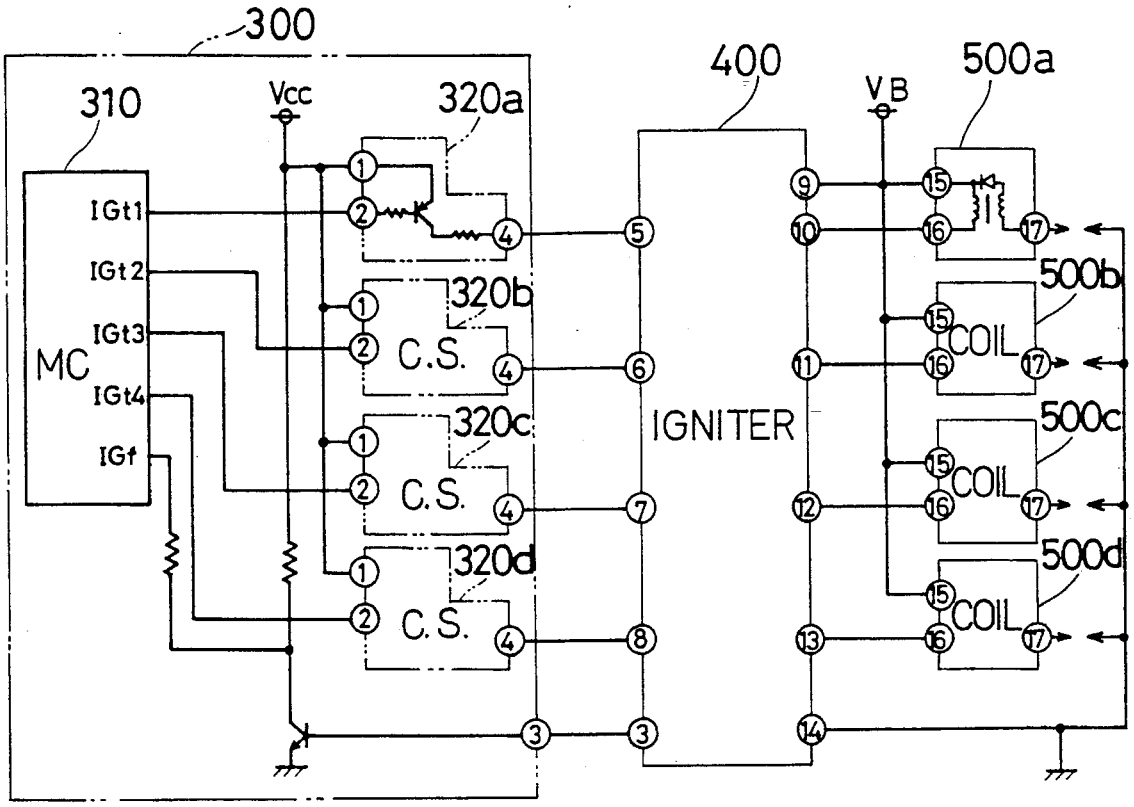
FIG. 27 is a circuit diagram showing an arrangement of a coil distribution ignition system in an ignition apparatus for an internal combustion engine according to another prior work.
Figure 28:
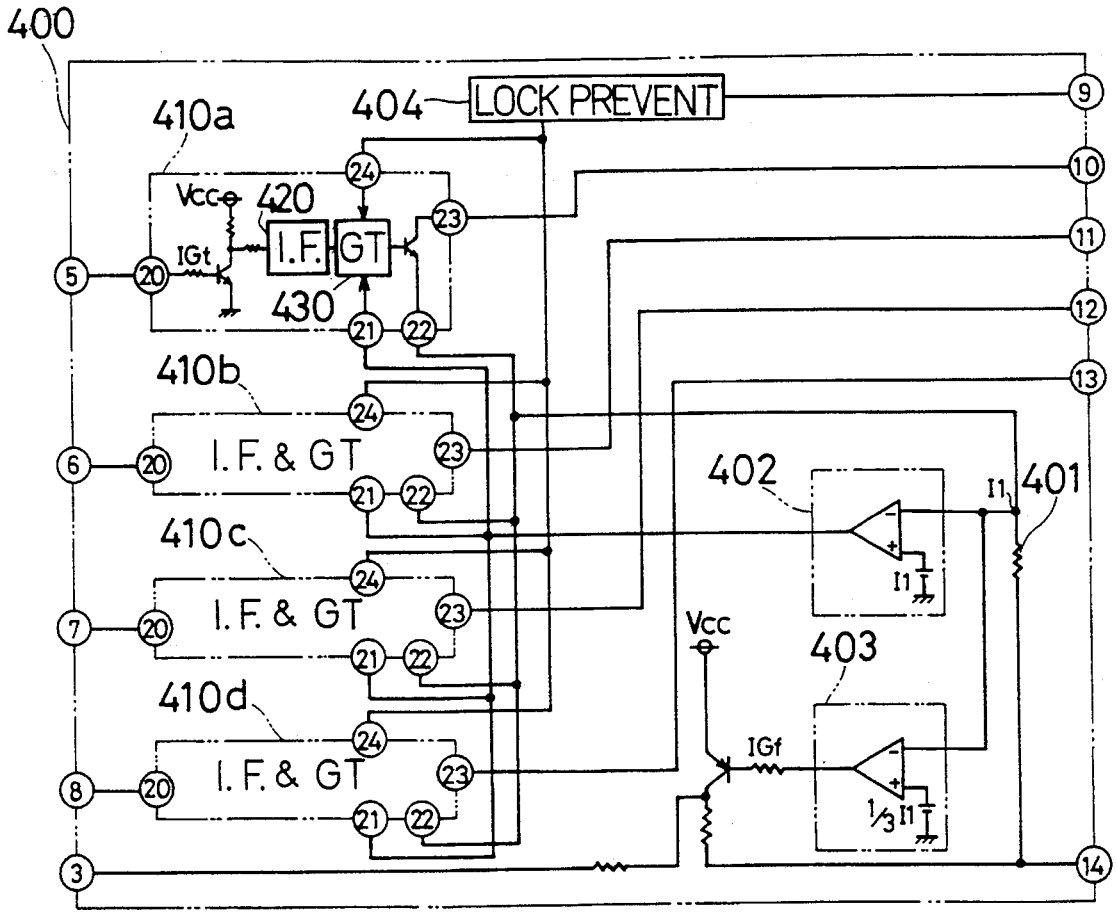
FIG. 28 is a circuit diagram showing a detailed circuit block employed in the igniter of FIG. 27.

FIG. 21 is a circuit diagram showing an arrangement of an ignition apparatus for an internal combustion engine according to a fifth embodiment of the present invention. FIG. 22 is a detailed circuit diagram showing circuit blocks, coil circuits, 1600*a* and 1600*b* of FIG. 21. FIG. 23A to FIG. 23F are timing charts showing signal waveforms appearing at various circuit portions in the circuit diagrams of FIG. 21 and FIG. 22. In this embodiment, there is shown an ignition apparatus for a coil distribution ignition type internal combustion engine which may detect an occurrence of an ignition failure.

The present embodiment is so arranged that ignition signals IGt1 and IGt2 corresponding to ignition coils of the respective two cylinders are produced from an ECU 1500 to the same circuit blocks 1600*a* and 1600*b* corresponding to coil circuits with an igniters, and a monitor signal IGf is returned from these circuits 1600*a* and 1600*b* to the ECU 1500.

The ECU 1500 is mainly constructed of a microcomputer 1510, a reference power supply Vcc to a battery power supply VB, and the same circuit blocks 1520*a*, 1520*b* for current supply. The circuit blocks 1600*a* and 1600*b* are mainly constructed by a control MIC 1601 for executing an input signal process and an output signal process; an ignition coil 1603; an IGBT 1602 for controlling a supply of a primary current of this ignition coil 1603; an I1 detecting resistor 1604 for detecting the primary energizing current of the ignition coil 1603; and a zener diode VZ1 for directly superimposing the primary voltage V1 of the primary winding of the ignition coil 1603 on the IGtf line. Further, the control MIC 1601 is mainly constructed by resistors R1, R2, a constant current control circuit 1610, and a zener diode VZ2.

With the above-described basic circuit arrangement, as shown in FIG. 21 and FIG. 22, both of the ignition signal IGt and the monitor signal IGf are transmitted/received by employing an IGtf signal line constructed of the single signal line for the ignition signal IGt and the monitor signal IGf. This IGtf line is to connect terminals, i.e., a terminal number 4 of the circuit blocks 1520*a* and 1520*b* of the ECU 1500 and a terminal number 6 of the circuit blocks 1600*a* and 1600*b* corresponding to the respective two ignition plugs. Then, in the circuit blocks 1600*a* and 1600*b*, the power to this control MIC 1601 is supplied by employing the IGtf signal line, whereas the receiving circuit of the ignition signal IGt employs the IGBT 1602 corresponding to the switching element.

As shown in the timing charts of FIG. 23A to FIG. 23F, in the ignition apparatus for the internal combustion engine with this arrangement, the primary voltage V1 is directly superimposed on the IGtf signal line by employing the zener diode VZ1. As a consequence, similar to the fourth embodiment, although such information that the ignition coil 1603 has electrically discharged the ignition plug cannot be directly returned as the monitor signal IGf to the ECU 1500, at least another information that the ignition coil 1603 has charged the magnetic energy can be returned as the monitor signal IGf to the ECU 1500. Also, the circuit blocks 1600*a* and 1600*b* can omit the resistors for dividing the primary voltage V1, as compared with the arrangement of the above-described fourth embodiment, and also since the gate electrode of the IGBT 1602 is no longer masked during the ignition, the masking transistor can be omitted. However, the level of the voltage superimposed on the IGtf signal line must be made constant by employing a zener diode VZ2.

As explained, according to this embodiment, the monitor signal IGf is produced by using both of the zener diode VZ1 for suppressing the primary voltage V1 of the ignition coil 1603 and the zener diode VZ2 for protecting over voltages. Accordingly, the information of the primary voltage V1 applied to the primary winding of the ignition coil 1603 can be directly superimposed on the IGft line via the zener diode VZ1 and can be returned as the monitor signal IGf to the ECU 1500.

The present invention described with reference to the first to fifth embodiments may be modified in various other ways without departing from the spirit of the invention.

What is claimed is:

1. An ignition apparatus for an internal combustion engine, which applies a high voltage to an ignition plug of the internal combustion engine, comprising:

an ignition coil means having a primary coil and a secondary coil; and an igniter circuit means for connecting/interrupting a supply of an energizing current to said primary coil in response to an ignition signal; wherein:

said ignition coil means and said igniter circuit means are assembled as a unit in an integral form, and said unit has a power supply terminal, a ground terminal, a terminal for the ignition signal, and an output terminal to which said ignition plug is connected;

said igniter circuit means includes:

a semiconductor switching element for connecting/interrupting the supply of the energizing current from said power supply terminal via said primary coil to said ground terminal in response to the ignition signal;

a constant current controlling circuit for detecting an energizing current to said primary coil and for blocking an input of the ignition signal to said semiconductor switching element in response to a detected value; and a monitor signal transmitting circuit for detecting an energizing current to said secondary coil so as to determine whether an ignition operation is normal or abnormal, and for transmitting a monitor signal in response to a determination result;

said monitor signal transmitting circuit is so arranged that after the ignition signal is ended, a voltage is applied to said ignition signal terminal, whereby said monitor signal is transmitted from said ignition signal terminal; and said igniter circuit means is further comprised of a mask circuit for blocking the supply of the energizing current to said primary coil by said semiconductor switching element while the monitor signal is transmitted.

2. An ignition apparatus for an internal combustion engine as claimed in claim 1, wherein:

said igniter circuit means is constructed in such a manner that a condition under which the voltage has been applied to said ignition signal terminal is recognized as an input condition of said ignition signal;

said semiconductor switching element is so constructed as to be conducted in response to said ignition signal;

said constant current controlling circuit is arranged to be operable by a voltage of the ignition signal; and said monitor signal transmitting circuit and said mask circuit are arranged to be operable with a voltage produced at said secondary coil.

3. An ignition apparatus for an internal combustion engine as claimed in claim 2, wherein:

said ignition plug is connected only with one end of said secondary coil;

said monitor signal transmitting circuit is comprised of a current detecting resistor provided at the other end of said secondary coil, and a diode for applying a voltage produced at said current detecting resistor as said monitor signal to said ignition signal terminal; and said mask circuit is comprised of a switching element for blocking supply of the energizing current to said primary coil based on the voltage produced at said resistor.

4. An ignition apparatus for an internal combustion engine as claimed in claim 1, wherein:

said ignition plug is connected only with one end of said secondary coil; and said monitor signal transmitting circuit is comprised of a current detecting resistor provided at the other end of said secondary coil, and a circuit for producing said monitor signal from a voltage of said power supply terminal based on a voltage generated at said current detecting resistor and for applying said monitor signal to said ignition signal terminal.

5. An ignition apparatus for an internal combustion engine as claimed in claim 1, wherein:

said monitor signal transmitting circuit is comprised of a generating coil provided with said ignition coil, and a circuit for applying a voltage generated at said generating coil as the monitor signal to said ignition signal terminal.

6. An ignition apparatus for an internal combustion engine as claimed in claim 1, wherein:

said ignition plug is connected only with said secondary coil; and said monitor signal transmitting circuit is comprised of an ion current detecting resistor employed between the other end of said secondary coil and said power supply terminal, and a circuit for producing the monitor signal based on a voltage generated at said ion current detecting resistor and for applying the monitor signal to said ignition signal terminal.

7. An ignition apparatus for an internal combustion engine, which applies a high voltage to an ignition plug of the internal combustion engine, comprising:

an ignition coil means having a primary coil and a secondary coil; and an igniter circuit means for connecting/interrupting a supply of an energizing current to said primary coil in response to an ignition signal; wherein:

said ignition coil means and said igniter circuit means are assembled as a unit in an integral form, and said unit has a power supply terminal, a ground terminal, a terminal for the ignition signal, and an output terminal to which said ignition plug is connected;

said igniter circuit means includes:

a semiconductor switching element connected to said ignition signal terminal, for connecting/interrupting the supply of the energizing current from said power supply terminal via said primary coil to the ground terminal in response to the ignition signal;

a constant current controlling circuit for detecting an energizing current to said primary coil and for blocking an input of the ignition signal to said semiconductor switching element in response to a detected value; and a monitor signal transmitting circuit for determining whether an ignition operation is normal or abnormal, and for transmitting a monitor signal in response to a determination result;

said igniter circuit means is constructed in such a manner that a condition under which the voltage has been applied to said ignition signal terminal is recognized as an input condition of the ignition signal;

said semiconductor switching element is so constructed as to be conducted in response to the ignition signal;

said constant current controlling circuit and said monitor signal transmitting circuit are operable by a voltage of the ignition signal; and said monitor signal transmitting circuit is arranged in such a way that the monitor signal is transmitted from said ignition signal terminal by lowering the voltage of said ignition signal terminal to a predetermined value.

8. An ignition apparatus for an internal combustion engine as claimed in claim 7, wherein:

said monitor signal transmitting circuit lowers the voltage of said ignition signal terminal to such a voltage at which said semiconductor switching element is conducted.

9. An ignition apparatus for an internal combustion engine as claimed in claim 8, wherein:

said semiconductor switching element is an insulated-gate bipolar transistor;

at least two resistor elements are series-connected between said ignition signal terminal and a gate of said IGBT; and said current control circuit connects a junction point between said two resistor elements to a ground terminal.

10. An ignition apparatus for an internal combustion engine as claimed in claim 7, wherein:

said unit has two output terminals to be connected to both ends of said secondary coil.

11. An ignition apparatus for an internal combustion engine as claimed in claim 7 further comprising:

control means having an output terminal for producing said ignition signal, said control means being comprised of an output circuit for producing said ignition signal by setting said output terminal to a predetermined voltage, and an input circuit for detecting the monitor signal by checking that the voltage of said output terminal becomes lower than the predetermined voltage.

12. An ignition apparatus for an internal combustion engine, which applies a high voltage to an ignition plug of the internal combustion engine, comprising:

ignition coil means having a primary coil and a secondary coil; and igniter circuit means for connecting/interrupting a supply of an energizing current to said primary coil in response to an ignition signal; wherein:

said ignition coil means and said igniter circuit means are assembled as a unit in an integral form, and said unit has a power supply terminal, a ground terminal, a terminal for the ignition signal, and an output terminal to which said ignition plug is connected;

said igniter circuit means includes:

a semiconductor switching element connected to said ignition signal terminal, for connecting/interrupting supply of the energizing current from said power supply terminal via said primary coil to said ground terminal in response to the ignition signal;

a constant current controlling circuit for detecting an energizing current to said primary coil and blocking input of the ignition signal to said semiconductor switching element in response to a detected value; and a monitor signal transmitting circuit for determining whether an ignition operation is normal or abnormal, and for transmitting a monitor signal in response to a determination result;

said monitor signal transmitting circuit is so arranged that after the ignition signal is ended, a voltage is applied to said ignition signal terminal, whereby said monitor signal is transmitted from said ignition signal terminal; and said igniter circuit means is further comprised of a mask circuit for blocking the supply of the energizing current to said primary coil by said semiconductor switching element while the monitor signal is transmitted.

13. An ignition apparatus for an internal combustion engine as claimed in claim 12, wherein:

said igniter circuit means is constructed in such a manner that condition under which the voltage has been applied to said ignition signal terminal is recognized as an input condition of the ignition signal;

said semiconductor switching element is conducted in response to the ignition signal;

said constant current controlling circuit is operable by a voltage of the ignition signal; and said monitor signal transmitting circuit and said mask circuit are operable while the voltage produced at said secondary coil is used as a power source.

14. An ignition apparatus for an internal combustion engine as claimed in claim 12, wherein:

said igniter circuit is operable by obtaining a power supply voltage from said power supply terminal.

15. An ignition apparatus for an internal combustion engine as claimed in claim 12, wherein:

said igniter circuit means is constructed in such a manner that a condition under which the voltage has been applied to said ignition signal terminal is recognized as an input condition of the ignition signal;

said semiconductor switching element is conducted in response to the ignition signal;

said constant current controlling circuit is operable by the voltage of the ignition signal; and said monitor signal transmitting circuit and said mask circuit are operable while a voltage generated from a generator coil added to said ignition coil is used as a power supply voltage.

16. An ignition apparatus for an internal combustion engine as claimed in claim 12, wherein:

said igniter circuit means is constructed in such a manner that a condition under which the voltage has been applied to said ignition signal terminal is recognized as an input condition of the ignition signal;

said semiconductor switching element is conducted in response to the ignition signal;

said constant current controlling circuit is operable by a voltage of the ignition signal; and said monitor signal transmitting circuit and said mask circuit are operable while a voltage appearing at a connection portion between said switching element and said primary coil is used as a power supply voltage.

17. An ignition apparatus for an internal combustion engine as claimed in claim 12, wherein:

said igniter circuit means is constructed in such a manner that a condition under which the voltage has been applied to said ignition signal terminal is recognized as an input condition of the ignition signal;

said semiconductor switching element is conducted in response to the ignition signal;

said constant current controlling circuit is operable by a voltage of the ignition signal; and said monitor signal transmitting circuit and said mask circuit are comprised of a first zener diode having a zener voltage, for connecting said power supply terminal side of said semiconductor switching element and said ignition signal terminal side; and a second zener diode provided in parallel to said constant current control circuit, for clipping a voltage of said ignition signal terminal to be lower than the zener voltage of said first zener diode.

* * * * *